US007685952B2

(12) United States Patent
Frost et al.

(10) Patent No.: US 7,685,952 B2
(45) Date of Patent: Mar. 30, 2010

(54) CAPSTAN ROLLERS FOR TUFTING MACHINE YARN FEED

(75) Inventors: Steve Frost, Signal Mountain, TN (US); Dan Cobble, Dalton, GA (US)

(73) Assignee: Tuftco Corporation, Charranooga, TN (US)

( * ) Notice: Subject to any disclaimer, the term of this patent is extended or adjusted under 35 U.S.C. 154(b) by 481 days.

(21) Appl. No.: 11/478,055

(22) Filed: Jun. 29, 2006

(65) Prior Publication Data

US 2007/0044695 A1 Mar. 1, 2007

Related U.S. Application Data

(60) Provisional application No. 60/695,843, filed on Jun. 30, 2005.

(51) Int. Cl.
*D05C 11/12* (2006.01)
*D05C 11/00* (2006.01)

(52) U.S. Cl. ..... 112/80.73

(58) Field of Classification Search ..... 112/80.7, 112/80.73, 302, 254, 98, 100, 101; 474/101
See application file for complete search history.

(56) References Cited

U.S. PATENT DOCUMENTS

| | | | | | |
|---|---|---|---|---|---|
| 2,247,244 | A * | 6/1941 | Lawson | 66/132 R |
| 3,095,840 | A * | 7/1963 | Ballard | 112/475.22 |
| 3,489,326 | A * | 1/1970 | Singleton | 226/109 |
| 4,411,207 | A * | 10/1983 | Brock et al. | 112/80.73 |
| 5,003,418 | A * | 3/1991 | Yang | 242/356.5 |
| 5,823,454 | A * | 10/1998 | Erck | 242/332 |
| 5,927,639 | A * | 7/1999 | Paepke et al. | 242/486.7 |
| 6,009,818 | A * | 1/2000 | Card et al. | 112/80.73 |
| 6,148,598 | A * | 11/2000 | Gabalda et al. | 57/352 |
| 6,244,203 | B1 * | 6/2001 | Morgante et al. | 112/475.23 |
| 6,725,789 | B1 * | 4/2004 | Hall | 112/80.73 |
| 6,733,408 | B2 * | 5/2004 | Reed | 474/101 |
| 7,080,601 | B2 * | 7/2006 | Hayashi et al. | 112/80.73 |

* cited by examiner

*Primary Examiner*—Ismael Izaguirre
(74) *Attorney, Agent, or Firm*—Douglas T. Johnson; Miller & Martin

(57) ABSTRACT

A capstan roller assembly is provided between the yarn supply and scroll type yarn feed attachments for a tufting machine in order to minimize the underfeeding of yarn to the pattern being tufted due to irregularities in the feeding of the yarn from the yarn supply.

27 Claims, 17 Drawing Sheets

CAPSTAN ROLLERS FOR TUFTING MACHINE YARN FEED

The present application claims priority to the Jun. 30, 2005 filing date of U.S. provisional patent application, Ser. No. 60/695,843, which is incorporated herein by reference.

BACKGROUND OF THE INVENTION

This invention relates to the operation of yarn feed mechanisms for tufting machines and more particularly to a scroll-type pattern controlled yarn feed wherein each set of yarn feed rolls is driven by an independently controlled servo motor. In one embodiment, a scroll-type pattern controlled yarn feed is provided wherein each yarn may be directed to a separate yarn feed device, and each yarn feed device is driven by an independently controlled servo motor. In another embodiment, a scroll-type pattern controlled yarn feed is provided where a plurality of yarns is directed to a yarn feed device, each yarn feed device being driven by an independently controlled servo motor, and the yarns may be distributed across the tufting machine to selected needles by the use of a tube bank.

Pattern control yarn feed mechanisms for multiple needle tufting machines are well known in the art and may be generally characterized as either roll-type or scroll-type pattern attachments. Roll type attachments are typified by J. L. Card, U.S. Pat. No. 2,966,866 which disclosed a bank of four pairs of yarn feed rolls, each of which is selectively driven at a high speed or a low speed by the pattern control mechanism. All of the yarn feed rolls extend transversely the entire width of the tufting machine and are journaled at both ends. There are many limitations on roll-type pattern devices. Perhaps the most significant limitations are: (1) as a practical matter, there is not room on a tufting machine for more than about eight pairs of yarn feed rolls; (2) the yarn feed rolls can be driven at only one of two, or possibly three speeds, when the usual construction utilizing clutches is used—a wider selection of speeds is possible when using direct servo motor control, but powerful motors and high gear ratios are required and the shear mass involved makes quick stitch by stitch adjustments difficult; and (3) the threading and unthreading of the respective yarn feed rolls is very time consuming as yarns must be fed between the yarn feed rolls and cannot simply be slipped over the end of the rolls, although the split roll configuration of Watkins, U.S. Pat. No. 4,864,946 addresses this last problem.

The pattern control yarn feed rolls referred to as scroll-type pattern attachments are disclosed in J. L. Card, U.S. Pat. No. 2,862,465, are shown projecting transversely to the row of needles, although subsequent designs have been developed with the yarn feed rolls parallel to the row of needles as in Hammel, U.S. Pat. No. 3,847,098. Typical of scroll type attachments is the use of a tube bank to guide yarns from the yarn feed rolls on which they are threaded to the appropriate needle to form a series of pattern repeats across the width of the backing material. In this fashion yarn feed rolls need not extend transversely across the entire width of the tufting machine and it is physically possible to mount many more yarn feed rolls across the machine. Typically, scroll pattern attachments have between 36 and 120 sets of rolls, and by use of electrically operated clutches each set of rolls can select from two, or possibly three, different speeds for each stitch. The use of servo motor driven scroll attachments as described in U.S. Pat. Nos. 6,244,203 and 6,283,053 by Morgante, et al. has maximized the precision and variety of scroll type patterns available to the industry.

The use of yarn feed tubes introduces additional complexity and expense in the manufacture of the tufting machine; however, the greater problem is posed by the differing distances that yarns must travel through yarn feed tubes to their respective needles. Yarns passing through relatively longer tubes to relatively more distant needles suffer increased drag resistance and are not as responsive to changes in the yarn feed rates as yarns passing through relatively shorter tubes. Accordingly, in manufacturing tube banks, compromises have to be made between minimizing overall yarn drag by using the shortest tubes possible, and minimizing yarn feed differentials by utilizing the longest tube required for any single yarn for every yarn. Tube banks, however well designed, introduce significant additional cost in the manufacture of scroll-type pattern attachments. Attempts to maximize tube bank efficiency are reflected in U.S. Pat. No. 6,244,203 by Morgante and U.S. Pat. Nos. 6,834,601 and 5,983,815 by Card.

One solution to the tube bank problems, which also provides the ability to tuft full width patterns is the full repeat scroll invention of Bardsley, U.S. Pat. No. 5,182,997, which utilizes rocker bars to press yarns against or remove yarns from contact with yarn feed rolls that are moving at predetermined speeds. Yarns can be engaged with feed rolls moving at one of two preselected speeds, and while transitioning between rolls, yarns are briefly left disengaged, causing those yarns to be slightly underfed for the next stitch. The use of single end servo motor driven yarn feed attachments, as reflected in U.S. Pat. No. 6,283,053 by Morgante, et al. has maximized the versatility of full repeat patterns by providing a wide range of stitch heights for each stitch at each needle.

Thus a servo motor driven pattern device might run a high speed drive shaft to feed yarn at 0.9 inches per stitch if the needle bar does not shift, 1.0 inches if the needle bar shifts one gauge unit, and 1.1 inches if the needle bar shifts two gauge units. Other slight variations in yarn feed amounts are also desirable, for instance, when a yarn has been sewing low stitches and it is next to sew a high stitch, the yarn needs to be slightly overfed so that the high stitch will reach the full height of subsequent high stitches. Similarly, when a yarn has been sewing high stitches and it is next to sew a low stitch, the yarn needs to be slightly underfed so that the low stitch will be as low as the subsequent low stitches. Therefore, there is a need to provide a pattern control yarn feed device capable of producing scroll-type patterns and of feeding the yarns from each yarn feed roll at an individualized rate, without yarn slippage.

Due to the considerations of cost and space, it is desirable to utilize the smallest servo motors that are adequate in speed and torque to provide precise yarn feeds to the needles. In some instances, such as reflected in dual end servo scroll pattern attachments, using the same yarn drives as are designed for single end servo scroll pattern attachments typified by U.S. Pat. No. 6,877,447, it has been desirable to enhance the gear ratios so that the servo motors provide additional torque, and patterning is not adversely affected by snags as yarn is fed from a creel to the pattern attachment. Furthermore, some types of pattern attachments, such as the full repeat scroll of Bardsley, U.S. Pat. No. 5,182,997, only feed yarns by pressure against a drive roller and are susceptible to yarn slippage in the case of snags. Therefore, a method is needed to reduce the possibility of yarn slippage so that patterns can be more precisely tufted.

SUMMARY OF THE INVENTION

It is therefore an object of this invention to provide in a multiple needle tufting machine a pattern controlled yarn feed mechanism incorporating a plurality of individually driven yarn feed rolls across the tufting machine, and a capstan roller to assure yarn is available to be freely fed by the yarn feed mechanism.

The capstan roller made in accordance with this invention includes a roller extending transversely of the tufting machine and engaging yarns intermediate the creel or yarn supply and the yarn feed mechanism.

It is another object of this invention to provide a yarn feed mechanism that operates at high speeds, with great accuracy, even in the event yarns should hang up or snag as being dispensed from the yarn supply.

DETAILED DESCRIPTION OF THE INVENTION

Figure 1:
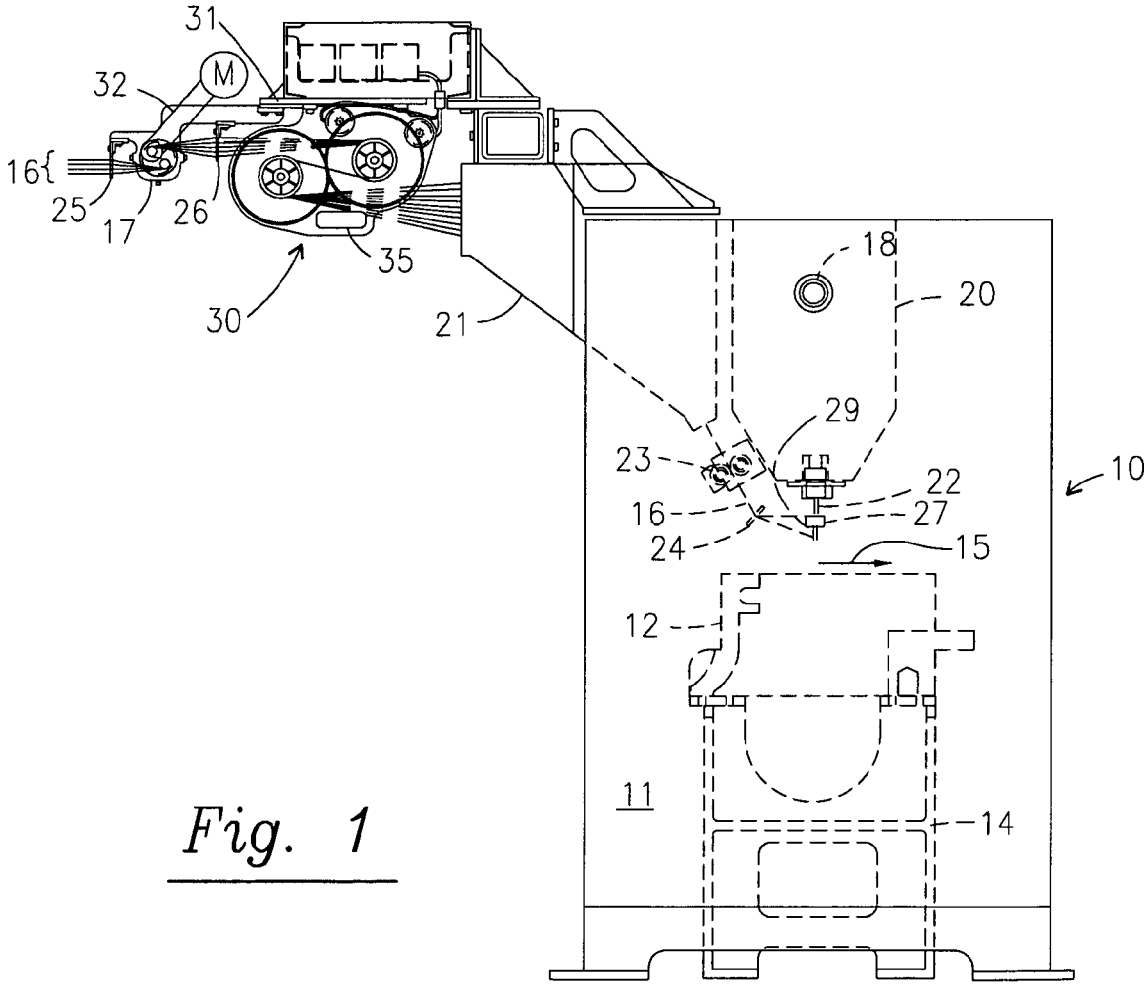
FIG. 1 is a side elevation of a multiple needle tufting machine incorporating a yarn feed mechanism and capstan roller assembly in accordance with the invention.
Figure 3:
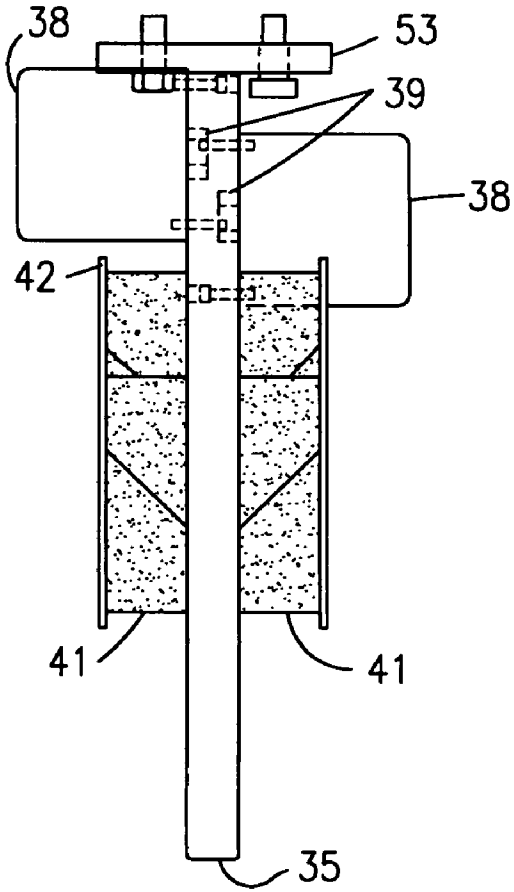
FIG. 3 is a rear plan view of the transverse support of FIG. 2.

Referring to the drawings in more detail, FIG. 1 discloses a multiple needle tufting machine 10 upon which is mounted a pattern control yarn feed attachment 30 in accordance with this invention. It will be understood that it is possible to mount attachments 30 on both sides of a tufting machine 10 when desired. The machine 10 includes a housing 11 and a bed frame 12 upon which is mounted a needle plate for supporting a base fabric adapted to be moved through the machine 10 from front to rear in the direction of the arrow 15 by front and rear fabric rollers. The bed frame 12 is in turn mounted on the base 14 of the tufting machine 10.

Figure 6:
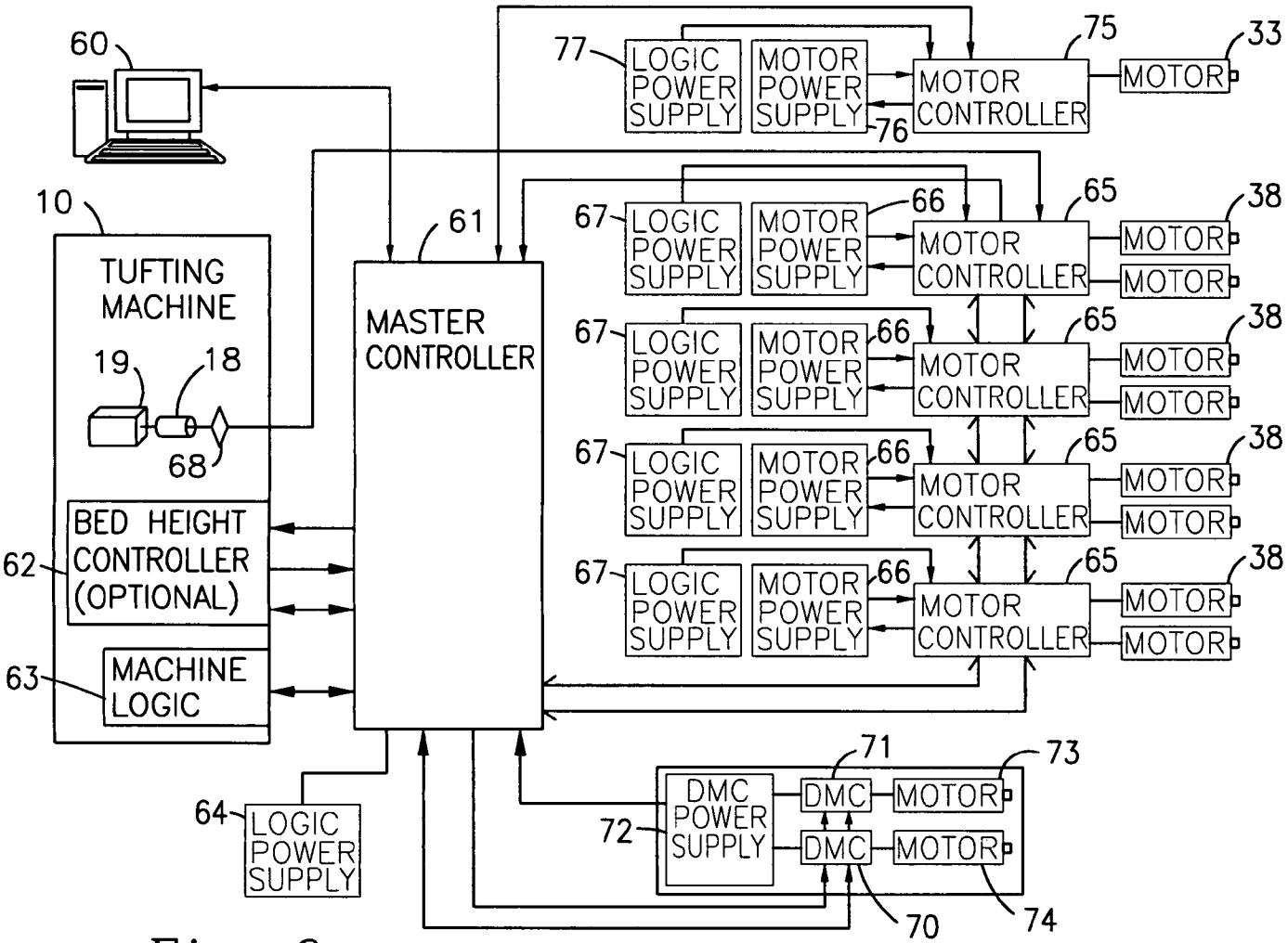
FIG. 6 is a schematic view of the electrical flow diagram for a multiple needle tufting machine incorporating a yarn feed mechanism and integrated capstan roller controls in accordance with the invention.
Figure 7A:
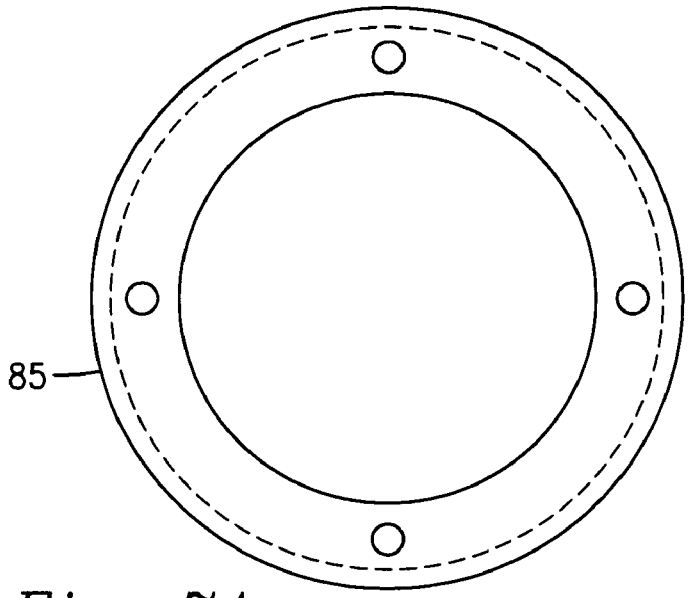
FIG. 7A is a side plan view of a pulley used in a capstan roller assembly of the present invention.
Figure 7B:
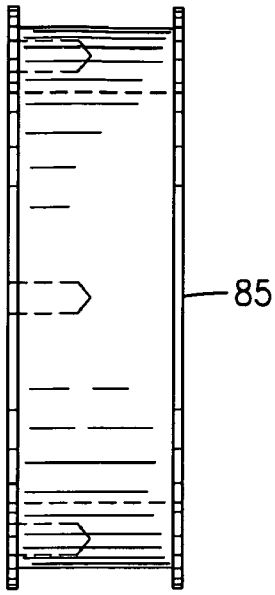
FIG. 7B is an end view of the pulley of FIG. 7A.

A main drive motor 19 schematically shown in FIG. 6 drives a rotary main drive shaft 18 mounted in the head 20 of the tufting machine. Drive shaft 18 in turn causes push rods 22 to move reciprocally toward and away from the base fabric. This causes needle bar 27 to move in a similar fashion. Needle bar 27 supports a plurality of preferably uniformly spaced needles 29 aligned transversely to the fabric feed direction 15. The needle bar 27 may be shiftable by means of well known pattern control mechanisms, not shown, such as Morgante, U.S. Pat. No. 4,829,917, or R. T. Card, U.S. Pat. No. 4,366,761. It is also possible to utilize two needle bars in the tufting machine, or to utilize a single needle bar with two, preferably staggered, rows of needles.

In operation, yarns 16 are fed through capstan rollers 17, pattern control yarn feed device 30, and tube bank 21. As explained below in connection with FIGS. 4 and 5, capstan rollers 17 provide an auxiliary yarn feeding functionality and insure the pattern control yarn feed device 30 may operate properly. Then yarns 16 are guided in a conventional manner through yarn puller rollers 23, and yarn guides 24 to needles 29. A looper mechanism, not shown, in the base 14 of the machine 10 acts in synchronized cooperation with the needles 29 to seize loops of yarn 16 and form cut or loop pile tufts, or both, on the bottom surface of the base fabric in well known fashions.

In order to form a variety of yarn pile heights, a pattern controlled yarn feed mechanism 30 incorporating a plurality of pairs of yarn feed rolls adapted to be independently driven at different speeds has been designed for attachment to the machine housing 11 and tube bank 21.

Figure 2:
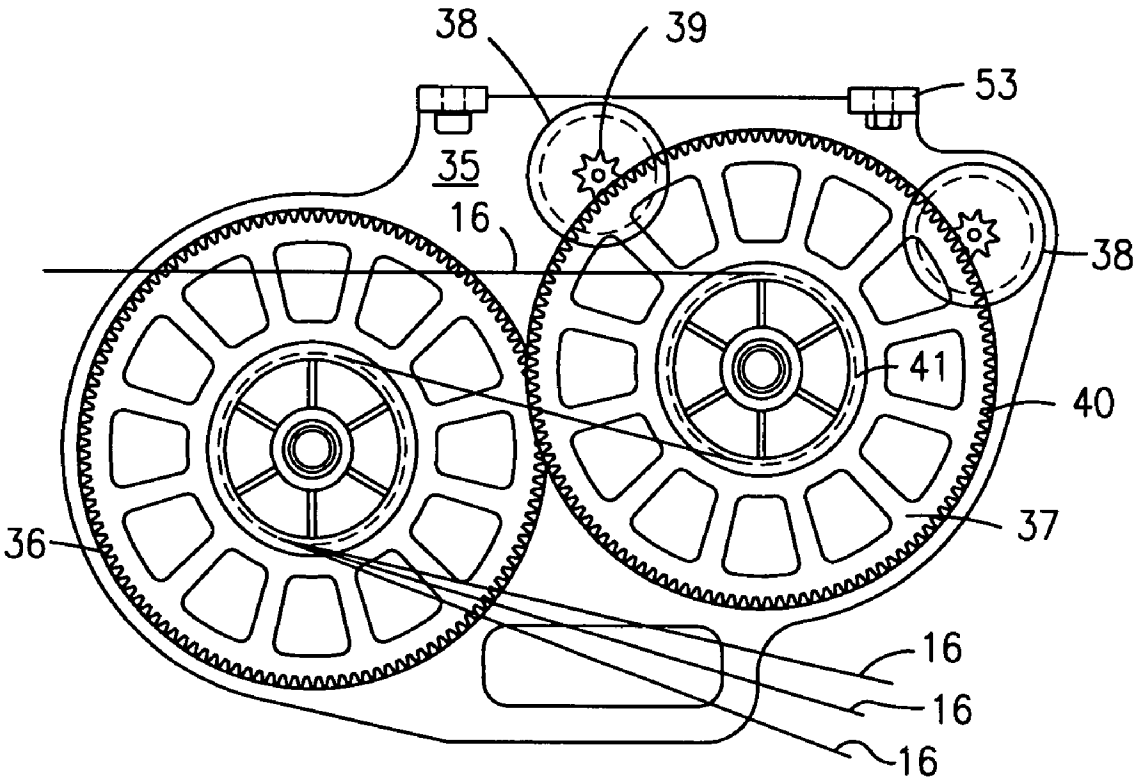
FIG. 2 is a side plan view of a transverse support holding a set of yarn feed rolls and the servo motor which controls their rotation.

As best disclosed in FIG. 1, a transverse support plate 31 extends across a substantial length of the front of tufting machine 10 and provides opposed upwards and downwards facing surfaces. On the upwards facing surface are placed the electrical cables and sockets to connect with servo motors 38. On the downwards facing surface are mounted a plurality of yarn feed roller mounting plates 35, shown in isolation in FIG. 2. Mounting plates 35 have connectors such as feet 53 to permit the plates 35 to be removably secured to the support plate 31 of the yarn feed attachment. Mounted on each side of each mounting plate 35 are a front yarn feed roll 36, a rear yarn feed roll 37 and a servo motor 38.

Each yarn feed roll 36, 37 consists of a relatively thin gear toothed outer section 40 which on rear yarn feed roll meshes with the drive sprocket 39 of servo motor 38. In addition, the gear toothed outer sections 40 of both front and rear yarn feed rolls 36, 37 intermesh so that each pair of yarn feed rolls 36, 37 are always driven at the same speed. Yarn feed rolls 36, 37 have a yarn feeding surface 41 formed of sand paper-like or other high friction material upon which the yarns 16 are threaded, and a raised flange 42 to prevent yarns 16 from sliding off of the rolls 36, 37. Preferably yarns 16 coming from yarn guides 26 are wrapped around the yarn feeding surface 41 of rear yarn roll 37, thence around yarn feeding surface 41 of front yarn roll 36, and thence into tube bank 21. Flanges 42 help insure yarns 16 remain on the yarn feeding surfaces 41. Because of the large number of independently driven pairs of yarn feed rolls 36, 37 that can be mounted in the yarn feed attachment 30, it is not anticipated that more than about 12 yarns would need to be driven by any single pair of rolls, which is a much lighter load providing relatively little resistance compared to the hundred or more individual yarns that might be carried by a pair of rolls on a roll type yarn feed attachment, and the thousand or more individual yarns that might be powered by a single drive shaft on some stitches in a traditional scroll-type attachment. In many cases less than 12, or even a single yarn, may be fed by a single yarn feed roll. By providing the servo motors 38 with relatively small drive sprockets 39 relative to the outer toothed sections 40 of yarn feed rolls 36, 37, significant mechanical advantage is gained. This mechanical advantage combined with the relatively lighter loads, and relatively light yarn feed rolls weighing less than one pound, permits the use of small and inexpensive servo motors 38 that will fit between mounting plates 35. This permits direct drive connection with the yarn feed rolls 36, 37 rather than a 90° connection as would be required if larger servo motors were used that sat upon the top of mounting plates 35. Preferably the gear ratio between yarn feed rolls 36, 37 and the drive sprocket 39 is about 15 to 1 with the yarn feed rolls 36, 37 each having 120 teeth and the drive sprocket 39 having 8 teeth. Motor sizes and gearing ratios may be adjusted depending upon the anticipated loads for the yarn drives.

Figure 4A:
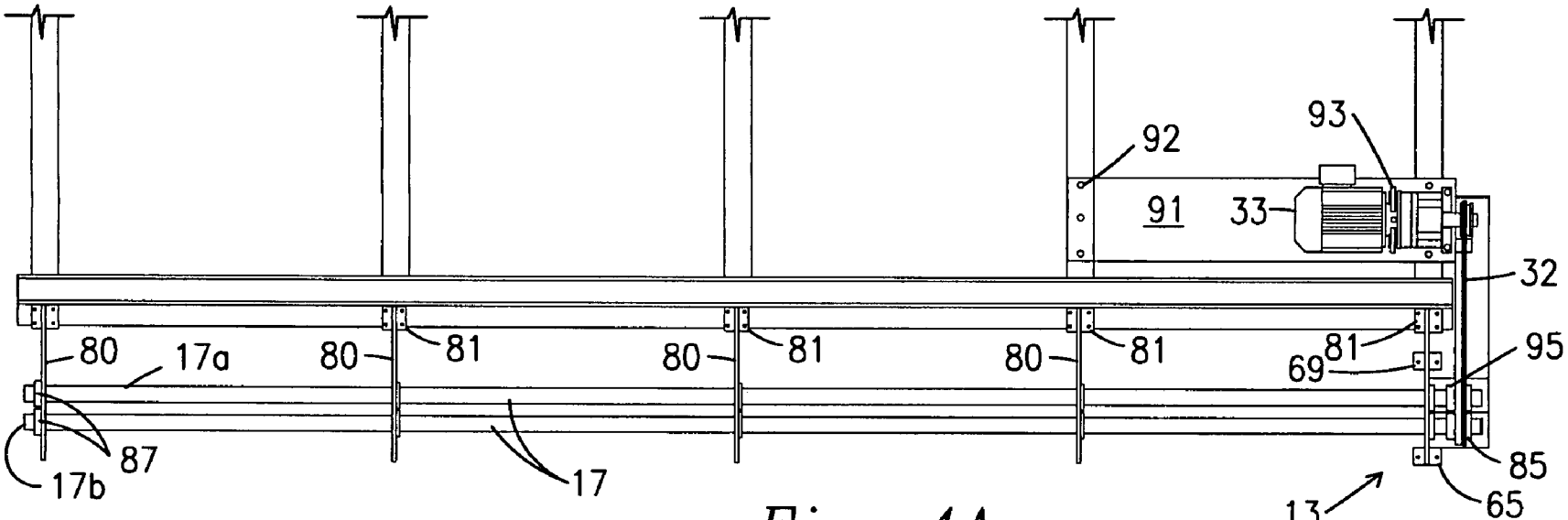
FIG. 4A is a top plan view of the capstan roller assembly of FIG. 1.
Figure 4B:
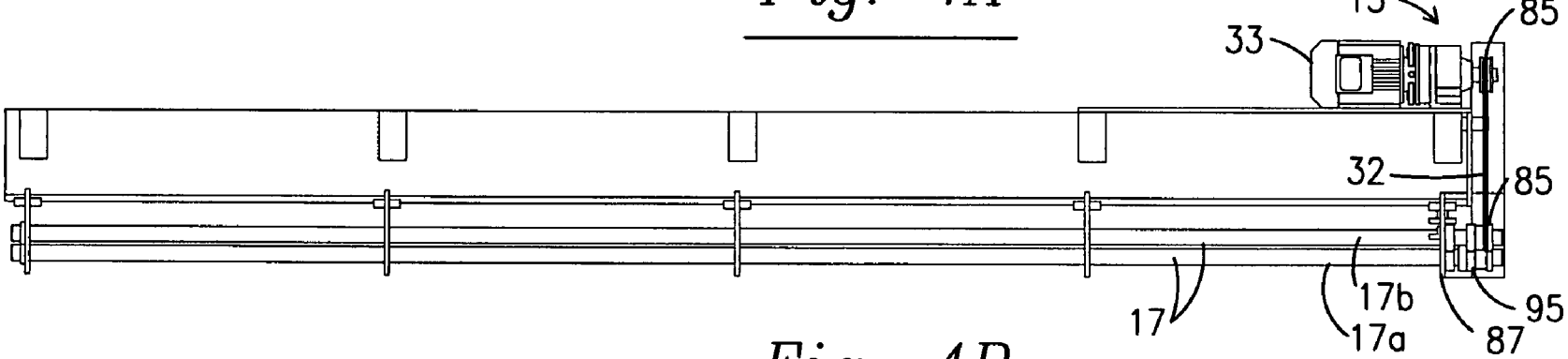
FIG. 4B is an end plan view of the capstan roller assembly of FIG. 1.
Figure 4C:
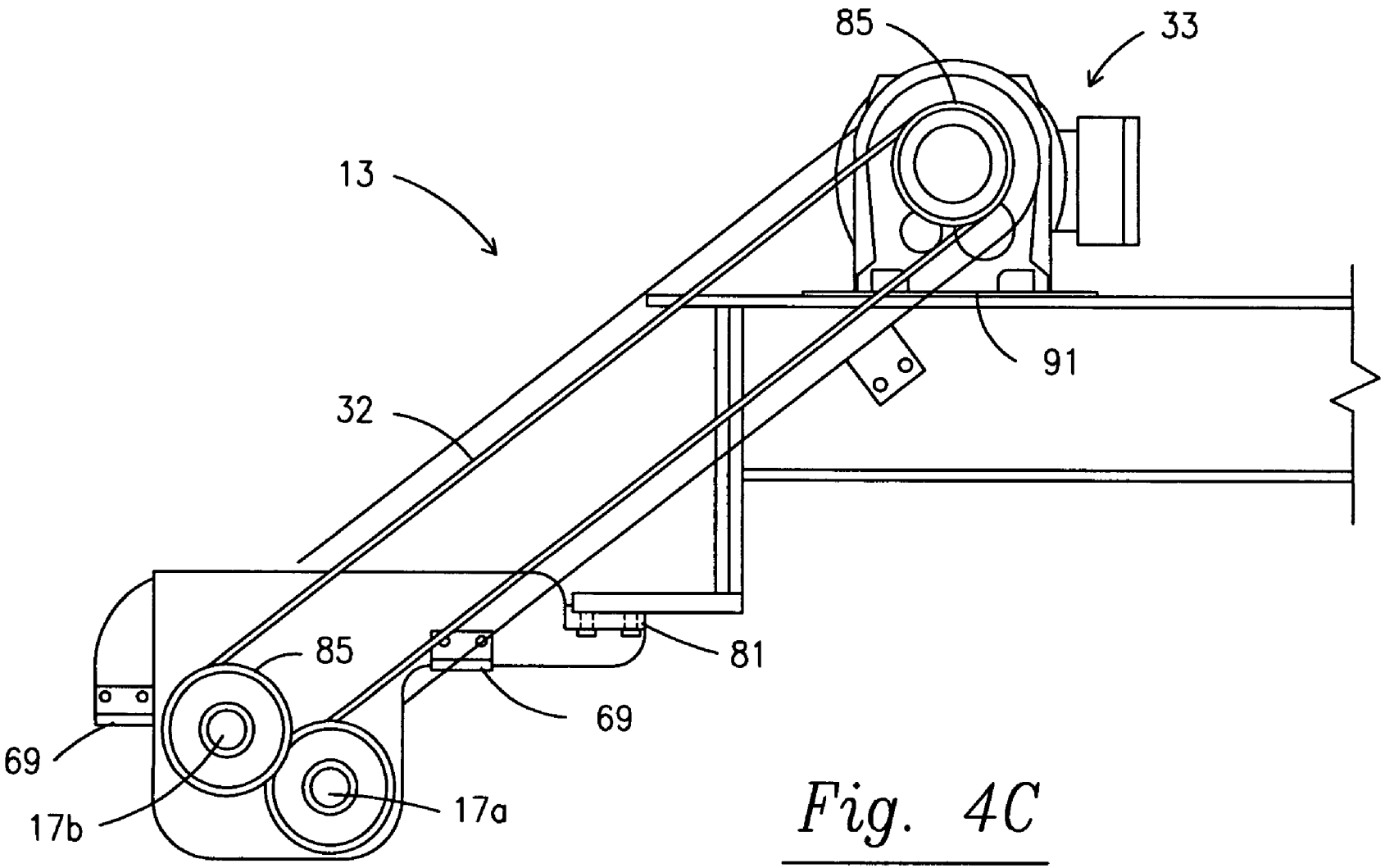
FIG. 4C is a side plan view of the capstan roller assembly of FIG. 1.

Turning then to FIG. 4A showing capstan roller assembly 13 comprising capstan rollers 17 driven by motor 33 communicating with rollers 17 by drive belt 32, it will be seen that yarns coming from the creel feed through front yarn guide 25 (shown in FIG. 1) and then under and substantially around each of lower capstan roller 17*a* and upper capstan roller 17*b*. In some instances, it may be preferable to use only a single capstan roller and to completely encircle that roller with each yarn as it is fed through rear yarn guide 26 to the yarn feed attachment 30. As shown in FIGS. 4*a*-4*c*, capstan motor 33 is mounted on motor base plate 41 secured atop yarn feed attachment 30. Capstan pulley wheel 85 is driven by motor 33 and communicates with another capstan pulley 85 on upper capstan roll 17*b*. Spur gears 95 on capstan rolls 17*a* and 17*b* cause the capstan rolls to rotate in opposite directions. Capstan rolls 17*a*, 17*b* are mounted in bushings 87 received in capstan roller brackets 80 positioned transversely along the front of the yarn feed attachment 30. It will be understood that this assembly may be mounted to yarn feed attachment 30 or may be located at any point intermediate the yarn supply and yarn feed attachment 30.

Figure 5C:
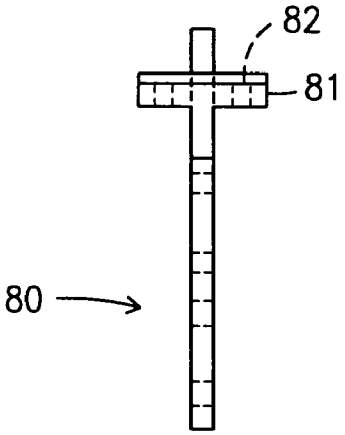
FIG. 5C is an end plan view of the capstan roller bracket of FIG. 5A.
Figure 5A:
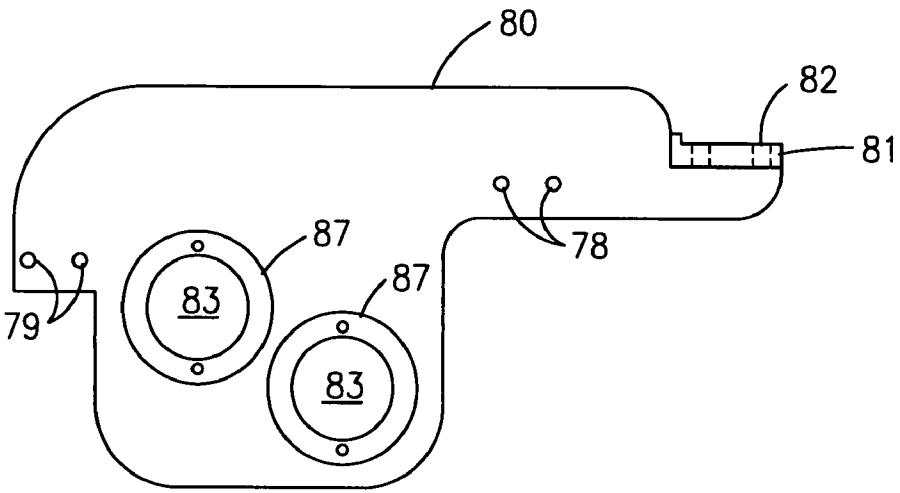
FIG. 5A is a side plan view of a capstan roller bracket suitable for use in the invention.
Figure 5B:
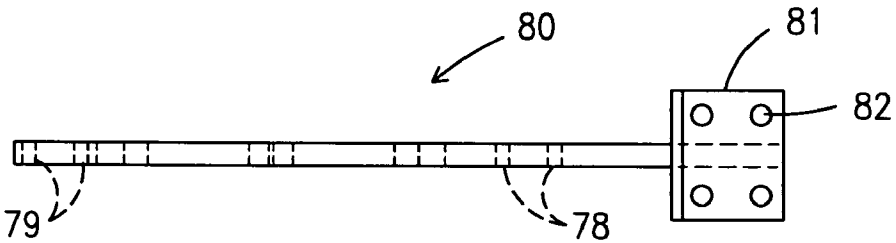
FIG. 5B is a top plan view of the capstan roller bracket of FIG. 5A.
Figure 8A:
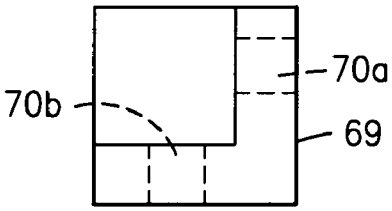
FIG. 8A is a front plan view of a yarn guide bracket used in a capstan roller assembly of the present invention.
Figure 8B:
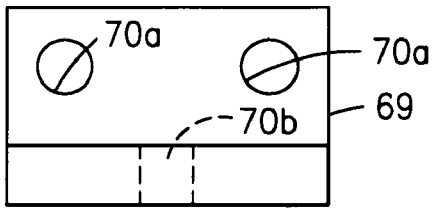
FIG. 8B is a side plan view of the yarn guide bracket of FIG. 8A.
Figure 8C:
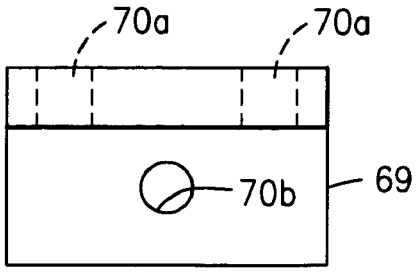
FIG. 8C is a bottom plan view of the yarn guide bracket of FIG. 8A.
Figure 9A:
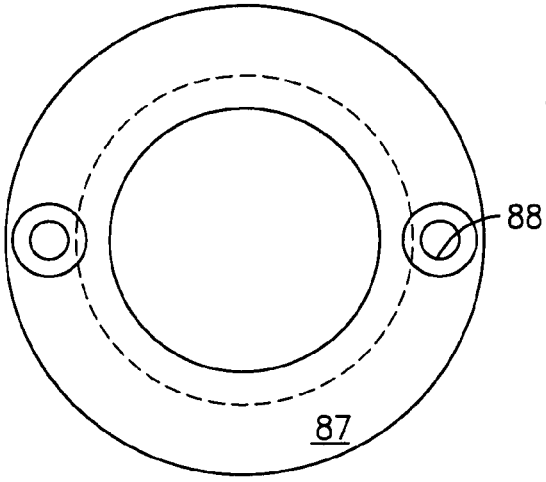
FIG. 9A is a side plan view of a bushing used in the capstan roller assembly of FIG. 4A.
Figure 9B:
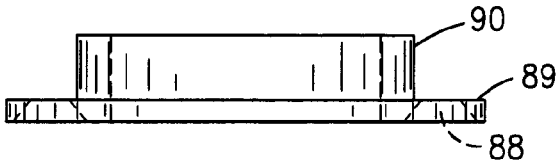
FIG. 9B is an end view of the bushing of FIG. 9A.

As shown in FIGS. 5*a*-5*c*, capstan roller brackets have mounting plate 81 with apertures 82 to permit the fastening of brackets 80 to the front of yarn feed attachment 30. Openings 83 are adapted to received bushings 87 (shown in detail in FIGS. 9*a* and 9*b*). Apertures 78 and 79 are adapted to facilitate fastening of yarn guide brackets 69 (shown in FIGS. 8*a*-*c*) with lateral apertures 70*a* to align with apertures 78 and 79 on brackets 80, and vertical apertures 70*b* to permit attachment of front and rear yarn guides 25, 26 (shown in FIG. 1.

Turning now to FIG. 6, a general electrical diagram of the invention is shown in the context of a computerized tufting machine. A personal computer 60 is provided as a user interface, and this computer 60 may also be used to create, modify, display and install patterns in the tufting machine 10 by communication with the tufting machine master controller 61. Master controller 61 in turn preferably interfaces with machine logic 63, so that various operational interlocks will be activated if, for instance, the controller 61 is signaled that the tufting machine 10 is turned off, or if the "jog" button is depressed to incrementally move the needle bar, or a housing panel is open, or the like. Master controller 61 may also interface with a bed height controller 62 on the tufting machine to automatically effect changes in the bed height when patterns are changed. Master controller 61 also receives information from encoder 68 relative to the position of the main drive shaft 18 or reciprocating elements from which the position of the needle bar can be determined, and preferably sends pattern commands to and receives status information from controllers 70, 71 for backing tension motor 74 and backing feed motor 73 respectively. Said motors 73, 74 are powered by power supply 72. Master controller 61 sends ratio metric pattern information to motor controllers 65. For instance, the master controller 61 might signal a particular motor controller 65 that it needs to rotate its corresponding servo motor 38 through 8.430 revolutions for the next stitch.

Motor controllers 65 also receive information from encoder 68 relative to the position of the main drive shaft 18 or similar data from which the position on the stitch guide can be determined. Motor controllers 65 process the ratiometric information from master controller 61 and stitch cycle positional information from encoder 68 to direct corresponding motors 38 to rotate yarn feed rolls 36, 37 the distance required to feed the appropriate yarn amount for each stitch. Motor controllers 65 preferably utilize only 5 volts of current for logic power supplies 67, just as master controller 61 utilizes power supply 64. In the preferred construction, motor power supplies 66 need provide no more than 100 volts of direct current at two amps peak. Master controller 61 also communicates with capstan motor controller 75 which in turn communicates instructions to capstan motor 33. Capstan motor controller 75 preferably utilizes only 5 volts of current for its logic power supply 75, however, the capstan motor power supply 76 generally must satisfy greater current demands than motor power supply 66 for the yarn feed devices. In this fashion, the master controller 61 can constantly have capstan motor 33 operating at a speed to cause the circumference of capstan rollers 17 to proceed at least at a speed equal to the greatest yarn feed speed for any yarn being fed to a needle during a particular stitch. Of course, it is not a requirement of the invention that the capstan motor be integrated into operation with the master controller 61. Alternatively, the capstan motor 33 may be operated independently and simply adjusted to a speed to cause the circumference of capstan roll 17 to move at a rate at least about as great as the fastest yarn feed rate that is achieved during a given pattern. The system described is implemented with either standardized or proprietary industrial control networks or field buses and enables the use of hundreds of possible yarn feed rates, preferably 128, 256 or 512 yarn feed rates for operation at speeds of 1500 stitches per minute. The cost of motor controllers 65 is minimized and throughput speed maximized by implementing the necessary controller logic in hardware, utilizing logic chips and programmable logical gate array chips.

Figure 10A:
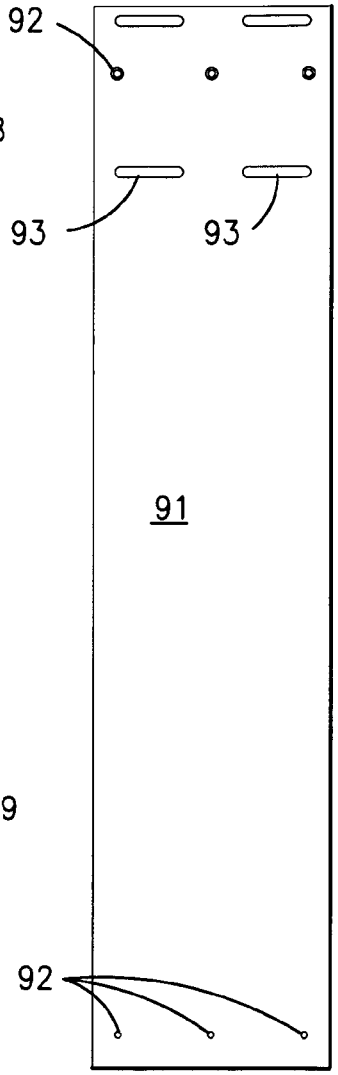
FIG. 10A is a top plan view of the motor base plate of the capstan roller assembly of FIGS. 4A-4C.
Figure 10B:
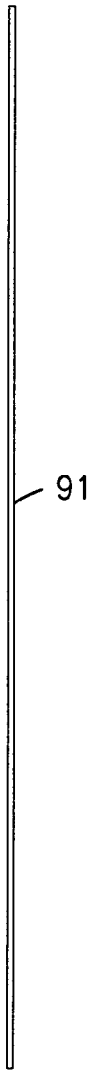
FIG. 10B is a side elevation view of the motor base plate of FIG. 10A.
Figure 11A:
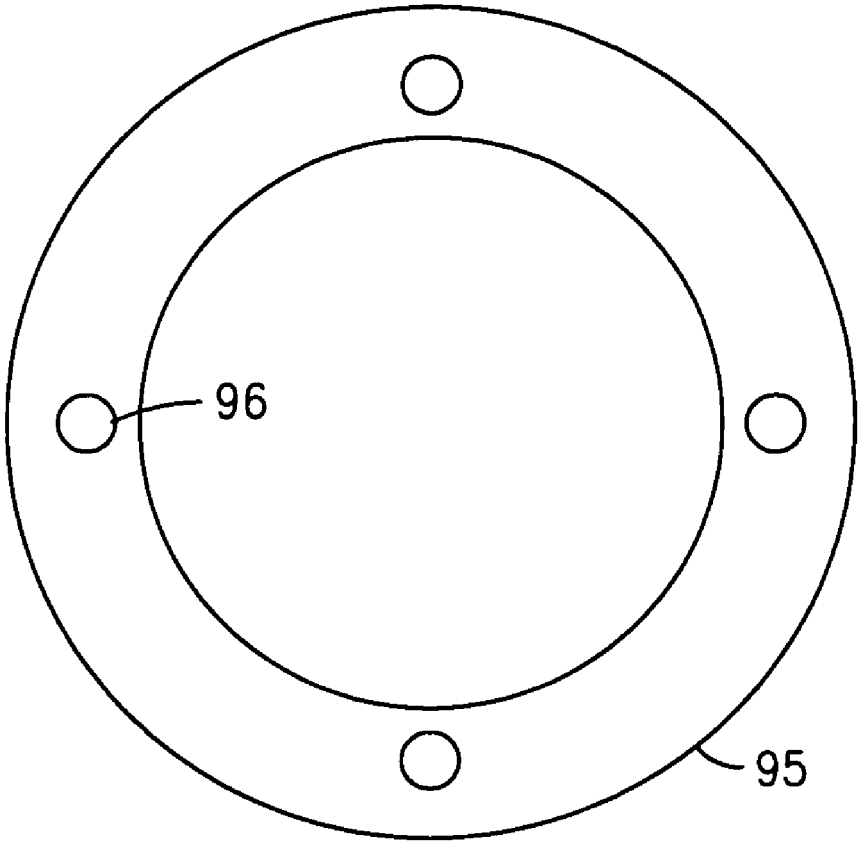
FIG. 11A is a side elevation view of a spur gear of the capstan roller assembly of FIGS. 4A-4C.
Figure 11B:
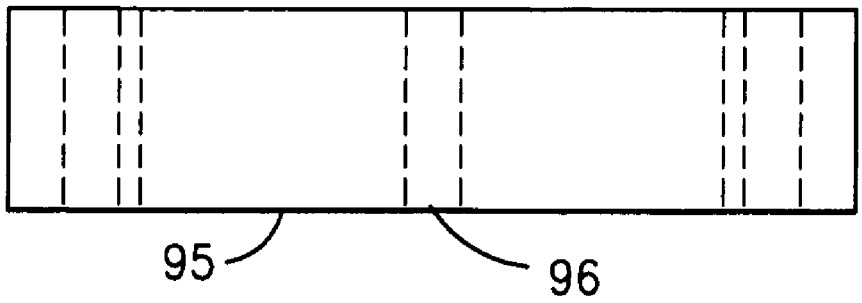
FIG. 11B is an end view of the spur gear of FIG. 11A.

Turning then to FIGS. 9-11, the components of a preferred design of capstan rollers according to the invention is disclosed. The motor base plate 91 of FIG. 10*a* has apertures 92 at each end to permit plate 91 to be secured on yarn feed attachment 30. Slots 93 receive feet of capstan motor 33. Bushings 87 have flange 89 with openings 88 to permit their secure mounting to bracket plate 80 so that bushing section 90 is received within openings 83. Spur gears 90 have apertures 96 to permit fastening to pulley 85 and intermeshing gears on spur gears 95 enable upper and lower capstan rollers 17*a*, 17*b* to turn at a uniform rate. In operation, yarns proceed from yarn supply, which is typically a yarn creel or series of yarn beams, through front yarn guide 25, about a capstan roll or rollers, through a rear yarn guide, and to yarn attachment 30. In the event that a yarn should snag when being fed from the yarn supply to yarn feed attachment 30, the yarn will become taut and exert pressure against capstan roll or rollers. When the taut yarn presses against the capstan roller, there is some frictional engagement so that the capstan roller urges the yarn in the yarn feed direction. The frictional engagement with a capstan roller adds to the pulling force exerted on the yarn by yarn feed motor 38 and tends to overcome snagging resistance. In this fashion, it is possible to operate yarn feed attachment 30 with smaller and less powerful and therefore less expensive yarn feed motors 38 than would otherwise be possible. It is also possible to utilize yarn feed drives in which the yarn is not as securely engaged with a yarn feed roll, similar to the pressure applied type drive of Bardsley, U.S. Pat. No. 5,182,997. When yarns are feeding from the yarn supply smoothly, the yarns are not taut and there is little tension applied by yarns 16 against capstan roller 17, and therefore the capstan roller 17 is relatively ineffective at advancing the yarns 16 at an accelerated rate. As a result, even though the capstan roll 17 has a circumference proceeding at a rate faster than yarns that are being fed for low pile height stitches, there is little tendency to accumulate excess lengths of yarn intermediate the capstan roll 17 and yarn feed attachment 30.

The illustrated yarn feed attachment 30 is intended to be used with tube banks specially designed to take advantage of the attachment's 30 capabilities. Tube banks described in Morgante, U.S. Pat. No. 6,244,203, U.S. patent application Ser. No. 10/966,319, in J. L. Card, U.S. Pat. No. 2,862,465, Card, U.S. Pat. No. 5,983,815 may be utilized.

Figure 12:
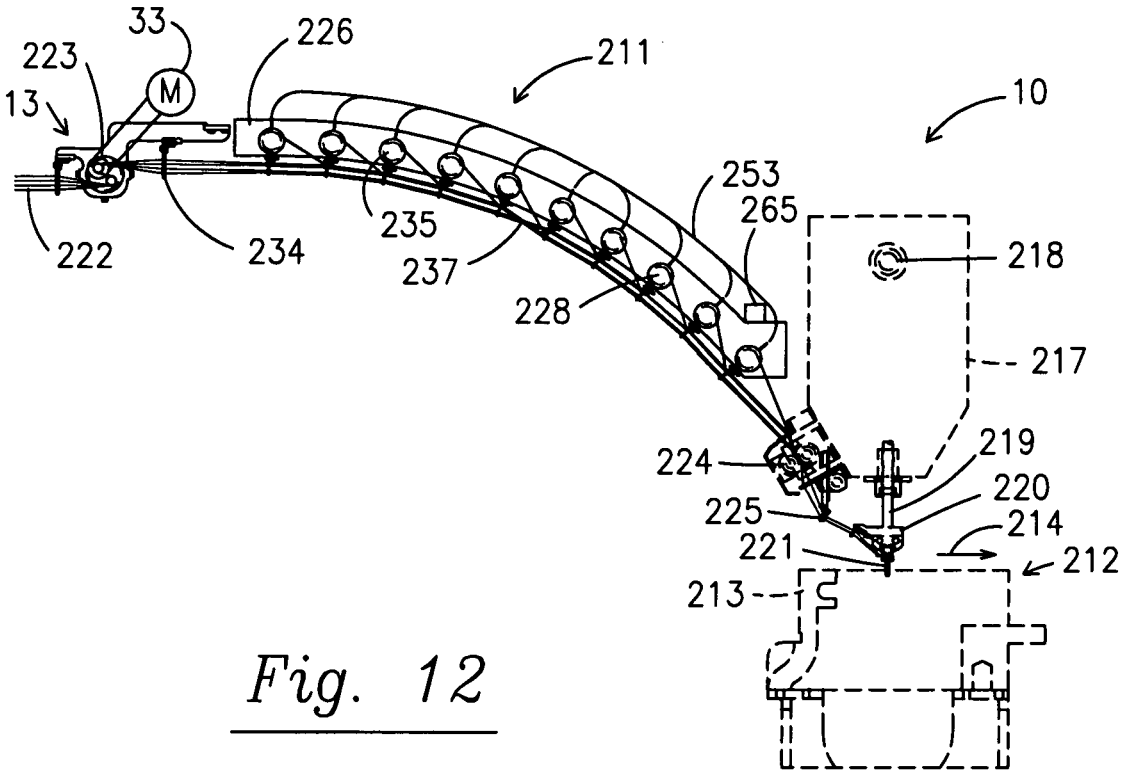
FIG. 12 is a side elevation view of the multiple needle tufting machine incorporating a pattern control yarn feed mechanism and capstan roll in accordance with the invention.

FIG. 12 discloses a multiple needle tufting machine 10 upon the front of which is mounted an alternative pattern control yarn feed attachment 211 in accordance with this invention. It will be understood that it is possible to mount such pattern control yarn feed attachments 211 on both sides of a tufting machine 10 when desired. The machine 10 includes a housing 212 and a bed frame 213 upon which is mounted a needle plate, not shown, for supporting a base fabric adapted to be moved through the machine 10 from front to rear in the direction of the arrow 214 by front and rear fabric rollers. The bed frame 213 is in turn mounted on the base 215 of the tufting machine 10.

Figure 15:
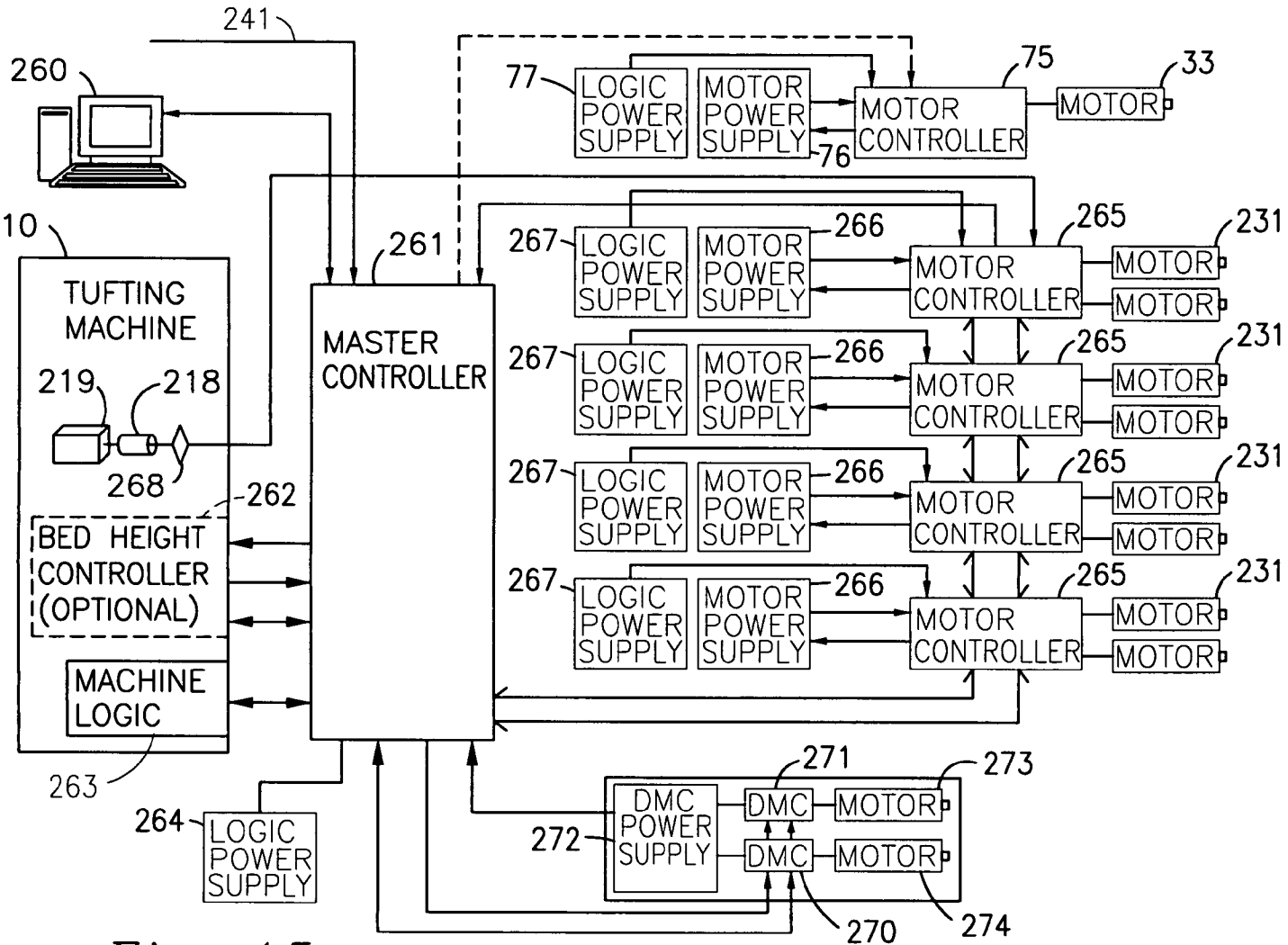
FIG. 15 is a schematic view of the electrical flow diagram for a multiple needle tufting machine incorporating a yarn feed mechanism made in accordance with the invention.

A main drive motor 219, schematically shown in FIG. 15, drives a rotary main drive shaft 218 mounted in the head 217 of the tufting machine. Drive shaft 218 in turn causes push rods 219 to move reciprocally toward and away from the base fabric. This causes needle bar 220 to move in a similar fashion. Needle bar 220 supports a plurality of preferably uniformly spaced needles 221 aligned transversely to the fabric feed direction 214. The needle bar 220 may be shiftable by means of well known pattern control mechanisms, not shown, such as Morgante, U.S. Pat. No. 4,829,917, or R. T. Card, U.S. Pat. No. 4,366,761. It is also possible to utilize two needle bars in the tufting machine, or to utilize a single needle bar with two, preferably staggered, rows of needles.

In operation, yarns 222 are fed through capstan rollers 223, into the pattern control yarn feed device 211. Then yarns 222 are guided in a conventional manner through yarn puller rollers 224, and yarn guides 225 to needles 221. A looper mechanism, not shown, in the base 215 of the machine 10 acts in synchronized cooperation with the needles 221 to seize loops of yarn 222 and form cut or loop pile tufts, or both, on the bottom surface of the base fabric in well known fashions.

In order to form a variety of yarn pile heights, a pattern controlled yarn feed mechanism 211 incorporating a plurality of yarn feed rolls adapted to be independently driven at different speeds is attached between the capstan rollers 223 and the yarn puller rollers 224.

As best disclosed in FIG. 12, a yarn drive array is assembled on an arching support bar 226 extending across the front of the tufting machine 10 and providing opposing vertical mounting surfaces on each of its sides and an upward facing top surface. On the opposing side-facing surfaces are mounted a total of 20 single or double end servo driven yarn feed rolls 228, ten on each side, shown in isolation in FIGS. 13, 14. It will be understood that the number of rolls on each support bar 226 may be varied for many reasons, especially in proportion to the gauge of the needles 221 on the needle bar 220. For instance, in the case of ⅛ gauge needle spacing (8 needles per inch) and support bars spaced every three inches, it would be desirable to carry 24 independently driven yarn feed rolls on each support bar 226 if a single yarn is carried by each yarn feed roll. In the case of double or quadruple yarn feeds, or a courser gauge, fewer yarn feed rolls are necessary, or alternatively, support bars may be spaced more widely. In practice, the support bars 226 should carry at least about 6, and preferably at least about 12, servo driven yarn feed rolls 228.

Figure 13:
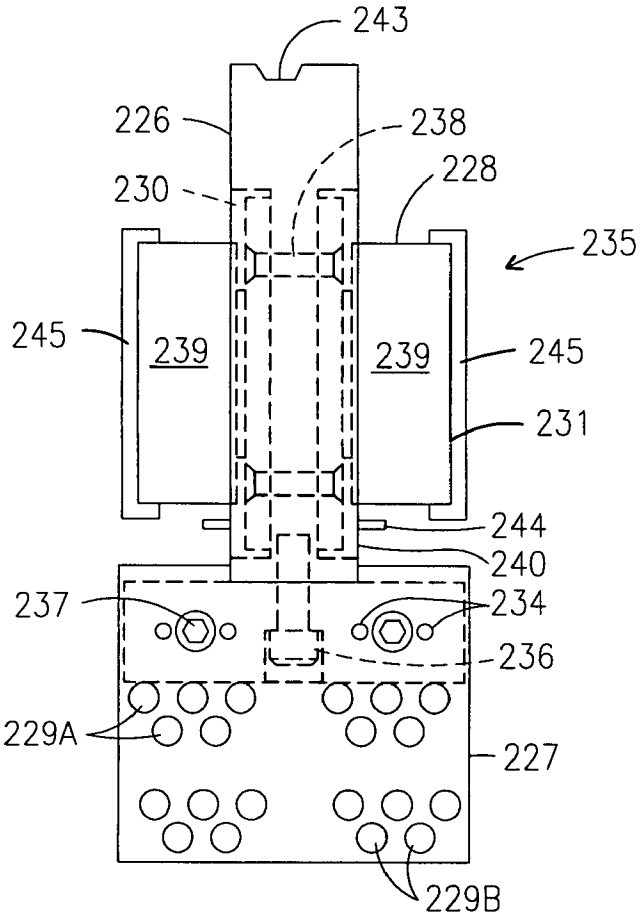
FIG. 13 is a rear elevation view of an arching support holding two yarn feed rolls, two servo motors that control yarn feed roll rotation, and yarn guide plate.

As shown in FIG. 12, the arching support bar 226 accommodates the wiring bundle 253 from the motors via the wiring path 243, shown in FIG. 13, built into the arching support bar 226, which facilitates the wiring of the motors. Wiring plugs join the wiring bundle 253 to leads connected to the motors 231 in yarn drives 235 and allow for easy servicing. Wiring bundle 253 is in turn connected to servo motor controller board 265 which may be in a central cabinet or installed on an arching support 226.

Each single end yarn drive 235 consists of a yarn feed roll 228 and a servo motor 231, shown in FIG. 13. The servo motor 231 may directly drive the yarn feed roll 228, which may be advantageously attached concentrically about the servo motor 231. A tension roll 232 shown in FIG. 14, controls the feed and wrapping of the yarn onto the yarn feed roll 228 to insure there is adequate traction of yarn 222 with roll 228. The yarn 222 is guided onto the tension roll 232 by the yarn guide plate 227. The position of the yarn guide plate 227 and the tension roll 232 is fixed with fastening screw 236. Preferably a yarn 222 is angled so that is wrapped around nearly 180° of the circumference of the yarn feed roll 228, and at least about 135° of said circumference, although the use of capstan rollers 223 makes this level of engagement with the yarn feed roll less important to effective operation. Yarn guide posts 234 protrude from the rear of yarn guide plates 227 and help ensure the proper placement of yarn 222 on yarn feed rolls 228. Although demonstrated single end yarn drives 235, with the capstan rollers 223 facilitating yarn feed to the yarn feed attachment 211, the drives 235 may be adapted to carry a plurality of yarns, typically two or four yarns per roll. Such a multiple yarn feed arrangement may be used effectively with or without a tube bank depending upon the patterns desired.

It will also be noted in FIG. 13 that yarns from the yarn supply are fed through upper 229*a* and lower 229*b* apertures on the support yarn guides 227. Specifically, a yarn 222 for a yarn feed drive 235 on the support distal from the tufting machine is fed through upper apertures 229*a* until it reaches its associated yarn drive, is fed around approximately 180° of the yarn feed roll 228 on its associated yarn drive 235, and continues through upper apertures 229*a* of the support yarn guides 227 until the midpoint of the support 226 is reached. At this point, the yarns 222 for the distal yarn feed drives 235 are threaded through lower apertures 229*b* in the remaining proximal yarn guides 227. Conversely, yarns for proximal yarn drives come from the yarn supply through lower apertures 229*b* in the distal yarn guides 227 until about the middle of the yarn drives and the support 226 when those yarns 222 are directed to the upper apertures 229*a* in the proximal yarn guides and cross the yarns from the distal yarn drives. In this fashion, the crossing of yarns occurs substantially at one point 237, opportunities for yarn friction and breakage minimized, and yarn threading simplified.

In a preferred embodiment depicted in FIG. 12, it is not necessary to cross the yarns, the offset position upper apertures 229*a* from lower apertures 229*b* in the yarn guide plate 227 being sufficient to permit yarns to continue through the same aperture position and around their designated yarn feed rolls 228 without significant friction between yarns 222.

Figure 16:
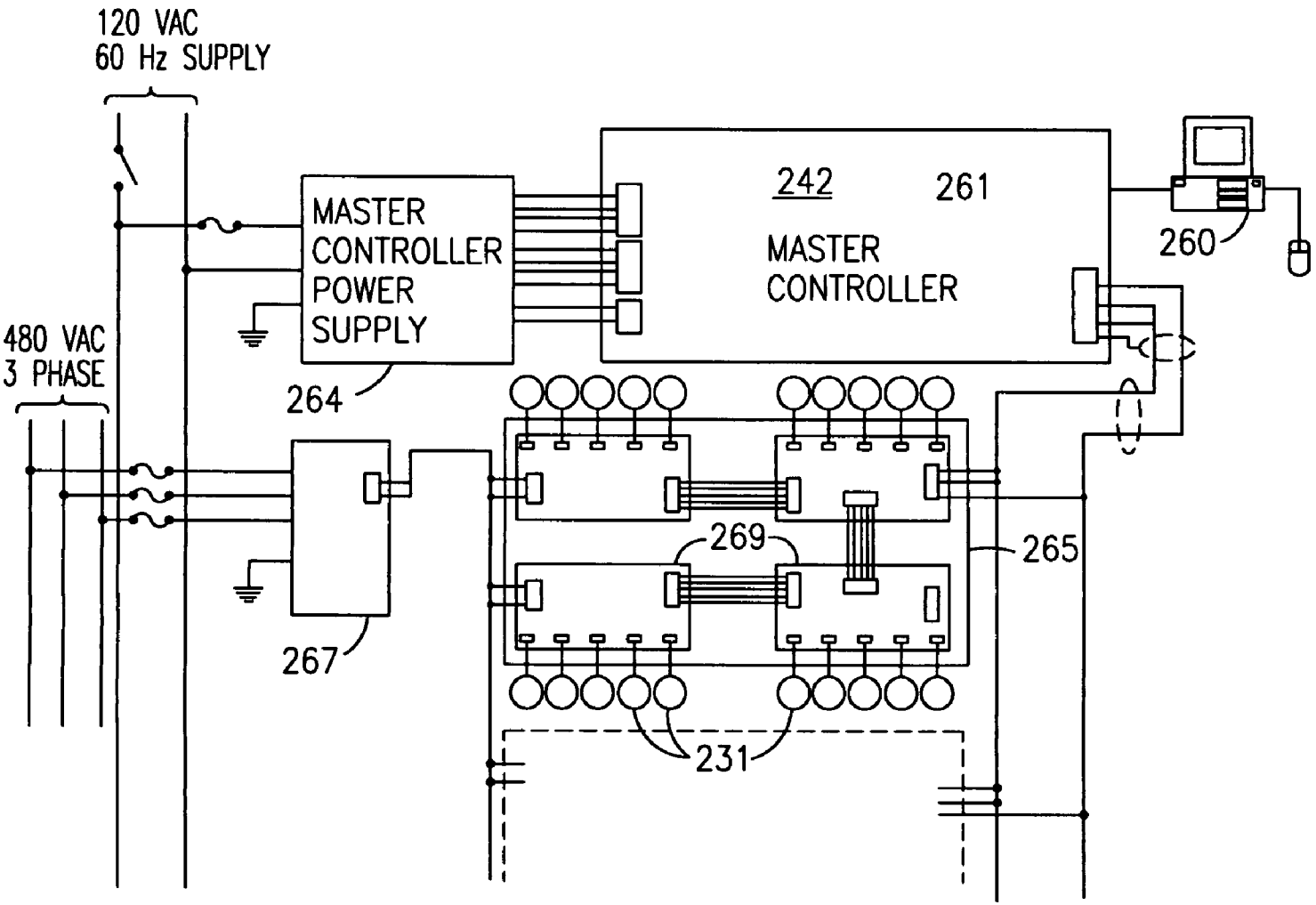
FIG. 16 is a schematic view of the electrical flow diagram for a single arched support carrying twenty servo motors.

As shown in FIG. 16, the invention is currently wired with four individual servo motor controllers 269, each controlling five motors 231. Collectively the four individual servo motor controllers comprise the servo motor controller board 265. It will be appreciated that the controllers 269 may be dispersed under separate cover plates or collectively mounted on a single board 265 under a single cover plate or even placed in a central controller cabinet depending upon wiring considerations. It will also be understood that more powerful controllers 269 might operate more than five motors 231 or in some instances fewer or even a single motor 231 might be operated by a controller 269. The most desirable wiring for a given application will depend upon the speed and price of available controllers as well as the speed at which the yarn feed attachment is intended to operate. Communications with master controller 261 are implemented with an open or proprietary industrial control network or field.

Figure 14:
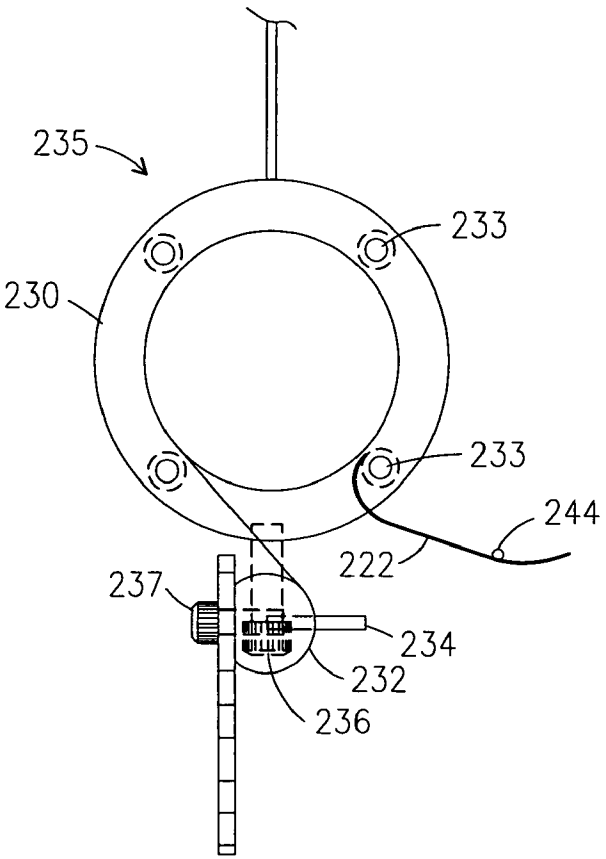
FIG. 14 is an alternative yarn guide plate.

It will also be seen in FIG. 14 that the servo motors 231 are set on base plates 230 of greater diameter than the yarn feed rolls 228 and are mounted onto the arching support bar 226 using four motor mount bolts 238 through mounting holes 233 in the base plates.

Each feed roll 228 has a yarn feeding surface 239 formed of a sand-paper like or other high friction material upon which the yarns are fed. Each of these yarn feed rolls 228 may be loaded with one yarn or several yarns (most commonly used one, two, or four yarns), which is a light load providing little resistance compared to the hundred or more yarns that might be carried on a roll-type yarn feed attachment, the hundreds of individual yarns typically driven by a single scroll drive shaft, or even the dozen yarns typically driven in the embodiment of FIG. 1. Because of the lighter loads used, and the capstan assembly 13, this design permits the use of small servo motors that can mount inside or outside of the yarn feed rolls 228. For instance, a typical motor for driving a single end of yarn would be a 24-28 volt motor using 3 amps of power. This motor would be able to generate 5 lb-in of torque at 3 amps, having a maximum no load speed of 650 RPM. A representative motor of this type is the Full Repeat Scroll Motor by Moog, Inc. (C22944), which meets these general specifications. A motor of this type is sufficiently powerful to turn the associated yarn feed roll without the need for any gearing advantage. Thus the preferred ratio of servo motor revolutions to yarn feed roll revolutions is 1:1.

Turning now to FIG. 15, a general electrical diagram of the invention is shown in the context of a computerized tufting machine. A personal computer 260 is provided as a user interface, and this computer 260 may also be used to create, modify, display and install patterns in the tufting machine 10 by communication with the tufting machine master controller 242. FIG. 15 shows the optional inclusion of the capstan assembly 13 in communication with master controller 261.

Due to the very complex patterns that can be tufted when individually controlling each end of yarn, many patterns will comprise large data files that are advantageously loaded to the master controller by a network connection 241; and preferably a high bandwidth network connection. For instance, digital representations of complex scroll patterns for traditional scroll pattern attachments might be stored in about 2 Kb of digital memory. A digital representation of a pattern for the single end servo driver scroll of the present invention might not repeat for 10,000 stitches and could require 20 Gb of disk space before data compression and about 20 Mb even after compression.

Master controller 261 in turn preferably interfaces with machine logic 263, so that various operational interlocks will be activated if, for instance, the controller 261 is signaled that the tufting machine 10 is turned off, or if the "jog" button is depressed to incrementally move the needle bar, or a housing panel is open, or the like. Master controller 261 may also interface with a bed height controller 262 on the tufting machine to automatically effect changes in the bed height when patterns are changed. Master controller 242 also receives information from encoder 268 relative to the position of the main drive shaft 218 or associated needle bar 220 and preferably sends pattern commands to and receives status information from controllers 270, 271 for backing tension motor 273 and backing feed motor 274 respectively. Said motors 273, 274 are powered by power supply 272. Finally, master controller 261, for the purposes of the present invention, sends ratiometric pattern information to the servo motor controller boards 265. The master controller 261 will signal a particular controller 269 on a servo motor controller board 265 that it needs to spin its particular servo motors 231 at given revolutions for the next revolution of the main drive shaft 218 in order to create the programmed pattern design. The servo motors 231 in turn provide positional control information to their servo motor controller 269 thus allowing two-way processing of positional information. Power supplies 267, 266 are associated with each servo motor controller board 265 and motor 231.

Master controller 261 also receives information relative to the position of the main drive shaft 218 or needle bar 220.

Servo motor controllers 269 process the ratiometric information and main drive shaft positional information from master controller 261 to direct servo motors 231 to rotate yarn feed rolls 228 the distance required to feed the appropriate yarn amount for each stitch.

In commercial operation, a typical broadloom tufting machine utilizes pattern controlled yarn feed devices 211 according to the present invention with 53 support bars 226, each bearing 20 single end yarn feed drives 235 thereby providing 1060 independently controlled yarn feed rolls 228. Alternatively, the yarn feed device may be configured with only about 500 to 800 yarn drives configured for feeding two ends of yarn through a tube bank of conventional or segmented designs. If any yarn feed roll 228 or associated servo motor 231 should become damaged or malfunction, the arched support bar 226 can be pivoted downward for ease of access. A replacement single end yarn drive 235 already fitted with a yarn feed roll 228 and a servo motor 231 can be quickly installed. This allows the tufting machine to resume operation while repairs to the damaged or malfunctioning yarn feed rolls and motor are completed, thereby minimizing machine down time.

The present feed attachment 211 provides substantially improved results by providing scroll type yarn control while eliminating the need for a tube bank unless some dual end configurations are desired.

The present design, unlike the previous art and the embodiment of FIG. 1, does not require tube banks to distribute the yarns 222 to the needle bar 220. Instead the yarns 222 may be directly routed to the needle bars 220 through the yarn guides 225. This is possible because yarns can be individually driven by feed rolls in directional alignment with the respective needles. By eliminating the tube banks, the source of friction variations is removed, eliminating the need for control schemes to correct for this problem. The capstan rollers also eliminate possible variations arising from snags when feeding the yarn from the creels to the pattern control attachment 211.

Figure 17:
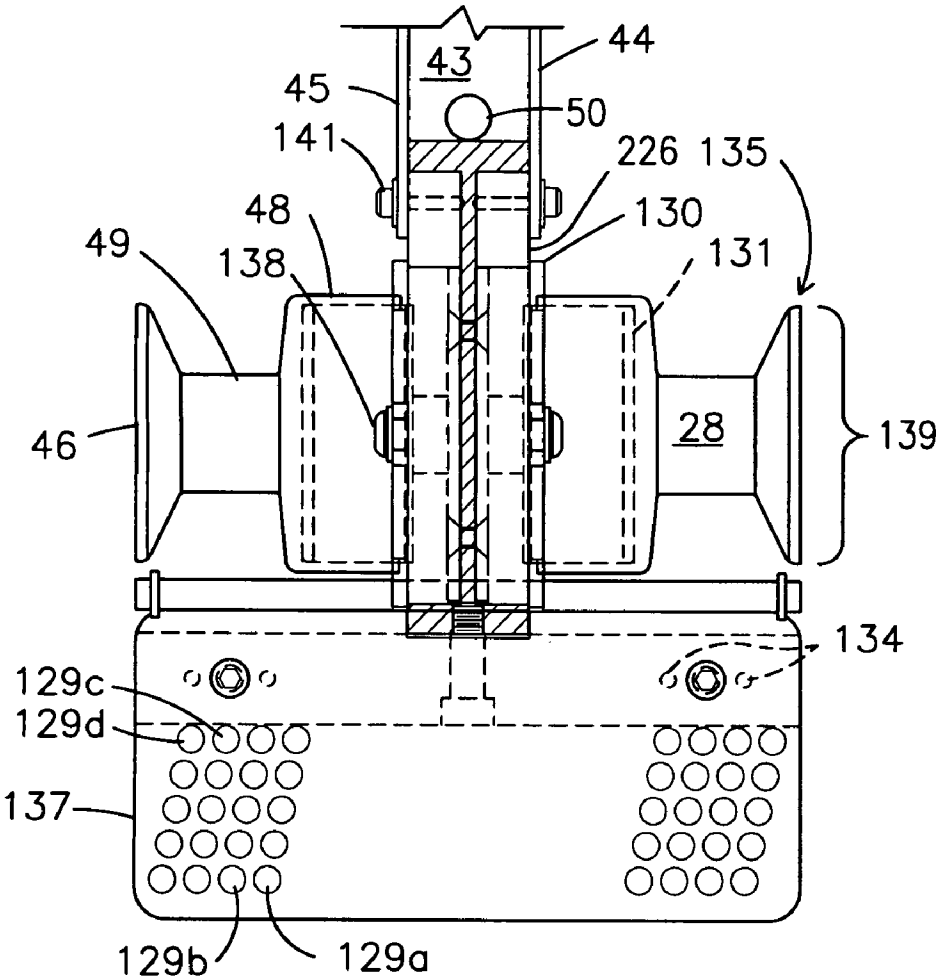
FIG. 17 is a rear elevation view of a section of a support holding two stepped down yarn feed rolls, two servo motors that control yarn feed roll rotation, and yarn guide plate.

A suitable modification of the yarn drives of FIGS. 12-14 to adapt to carry two or four yarns is shown in FIG. 17. An array of yarn drives 135, each configured to carry two yarns, is assembled on an arching support bar 226 extending from the front of the tufting machine 10 and providing opposing vertical mounting surfaces on each of its sides and an upward facing top surface. On the opposing side-facing surfaces are preferably mounted a total of twenty servo motors 131 and driven yarn feed rolls 139, ten on each side. It will be understood that the number of rolls on each support bar 226 may be varied for many reasons, especially in proportion to the gauge of the needles on the needle bar 27 and the number of yarns carried by each roll. In practice, the support bars 226 should carry at least about six, and preferably at least about twelve, double (or quadruple) end servo driven yarn feed rolls 139. Typically, each support bar 226 will carry a complement of twenty servo motor driven yarn feed rolls 139, and the spacing of the support bars will be adjusted to suit the needle gauge and number of yarns on the roll.

The arching support bar 226 accommodates the wiring bundle 50 from the motors via the wiring path 43, shown in FIG. 17, built into the arching support bar 226, which facilitates the wiring of the motors. Wiring plugs join the wiring bundle 50 to leads connected to the motors 131 and allow for easy servicing. Wiring bundle 50 is in turn connected to servo motor controller board, which may be in a central cabinet or installed on an arching support 226.

Each double end yarn drive 135 consists of a yarn feed roll 139 and a servo motor 131. In one embodiment, the servo motor 131 directly drives the yarn feed roll 139, which may be advantageously attached concentrically about the servo motor 131, as shown in FIG. 17. Preferably a yarn 16 is directed by yarn guide plates 137 and other conventional designs so that the yarn is wrapped around nearly 180° of the circumference of the yarn feeding surface 28 of the yarn feed roll, and at least about 135° of said circumference. As shown in FIG. 17, yarn guide posts 134 may protrude from the yarn guide plates 137 in the general direction of the yarn feed, and help ensure the proper placement of two yarns 16 on yarn feed rolls 139.

It will also be noted in FIG. 17 that yarns 16 from the yarn supply are fed through apertures 129 on the support yarn guides 137. Because two ends of yarn are wrapped around each of the ten yarn feed rolls 139 on one side of the support, twenty apertures 129 are required on each of the left and right sides of the yarn guide plate 137 to accommodate the yarns. Yarns 16 being wrapped and driven by a contacting yarn feed roll 139 distal from the tufting machine 10 enter the apertures 129*a*, 129*b* with each of the two yarns to a particular yarn feed roll 139 threaded through adjacent apertures. For example apertures 129*a* and 129*b* could have yarns driven by the same yarn feed roll 139. Yarns from a yarn feed roll 139 quite proximal to the tufting machine would occupy apertures 129*c* and 129*d*. The apertures 129 are arranged in parallel, diagonally offset rows. The arrangement allows all the yarn ends for each of the yarn feed rolls 139 to be directed through the attachment to the proper needles without introducing unwanted friction between individual yarns.

It will also be seen in FIG. 17 that the servo motors 131 are advantageously set on base plates 130 of greater diameter than the yarn feed rolls 139, which permits the base plate 130 and attached motors 131 to be mounted on the support bar 226 with several motor mount bolts 138. Additional fasteners 141 are used to secure covers 44, 45 or circuit board assemblies over support 226, thereby defining wiring path 43.

Each feed roll 139 has a yarn feeding surface 28 formed of a sand-paper like or other high friction material upon which the yarns are fed. As shown in FIG. 17, end caps 46 help ensure the yarns 16 remain on the feeding surface 28, and may protect motors 131 from dust or other contamination. Each of the yarn feed rolls 139 may be loaded with about two to four yarns, which is a light load providing little resistance compared to the hundred or more yarns that might be carried on a roll-type yarn feed attachment, the hundreds of individual yarns typically driven by a single scroll drive shaft, or even the dozen yarns typically driven in the commonly assigned servo-scroll patent, U.S. Pat. No. 6,244,203. Because of the lighter loads involved in feeding only two yarns and the additional feeding pull supplied by capstan assembly 13, the present design permits the use of small servo motors that can mount inside or outside of the yarn feed rolls 139. For instance, a typical motor for a double or quadruple end yarn drive would be a 24-28 volt motor using 3 amps of power. This motor would be able to generate 5 lb-in of torque at 3 amps, having a maximum no load speed of 650 RPM. A representative motor of this type is the Full Repeat Scroll Motor by Moog, Inc. (C22944), which meets these general specifications. A motor of this type is sufficiently powerful to turn the associated yarn feed roll without the need for any gearing advantage in many situations, in which case the ratio of servo motor revolutions to yarn feed roll revolutions is 1:1.

However, in some applications, especially utilizing heavy and irregular yarns with frequent low stitch height to high stitch height yarn feed changes, additional torque may be preferred. Accordingly, modified yarn feed rolls 49 are shown in FIG. 17. These yarn feed rolls 49 have a mounting section 48 that fits over and engages servo motors 131, a stepped down diameter yarn feeding surface 28, and an end cap portion 46. The associated yarn guide plate 137 is also modified to a wider structure than that used with the yarn feed rolls, shown in FIGS. 12-14, so that the apertures 129 for feeding yarns are generally aligned beneath the yarn feeding surfaces 28. By reducing the diameter of the yarn feed surface portion 28 of the yarn feed rolls, a single revolution of servo motor 131 feeds less yarn, effectively reducing the maximum yarn feed rate and increasing the torque of the yarn feed drive 135.

Figures 18A, 18B:
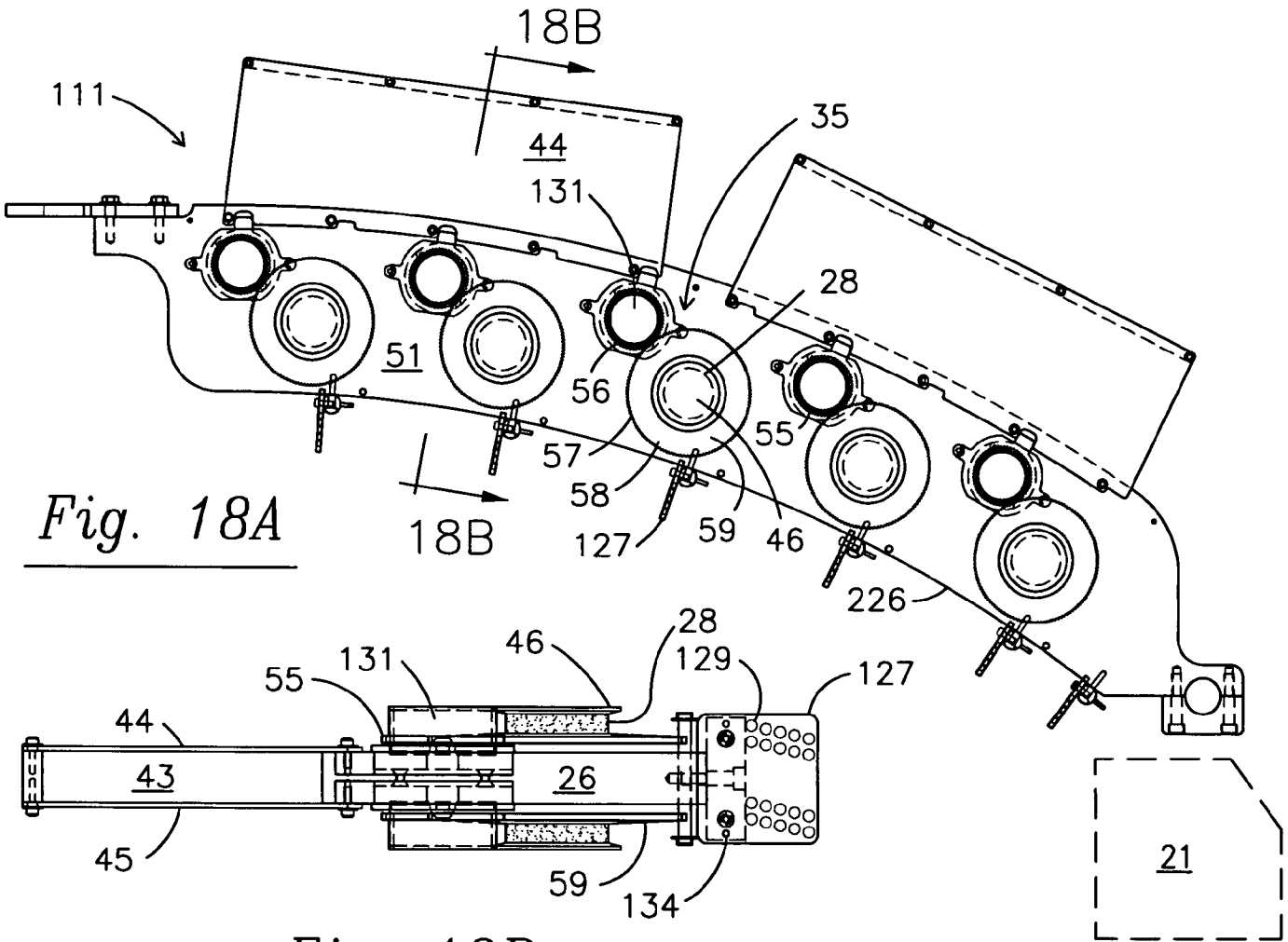
FIG. 18A is a side elevation view of a double-end pattern control yarn feed support utilizing a geared drive system.
FIG. 18B is a rear elevation view of the invention of FIG. 18A, taken along a section of the support bar and showing two yarn drives and a yarn guide plate.
Figure 19:
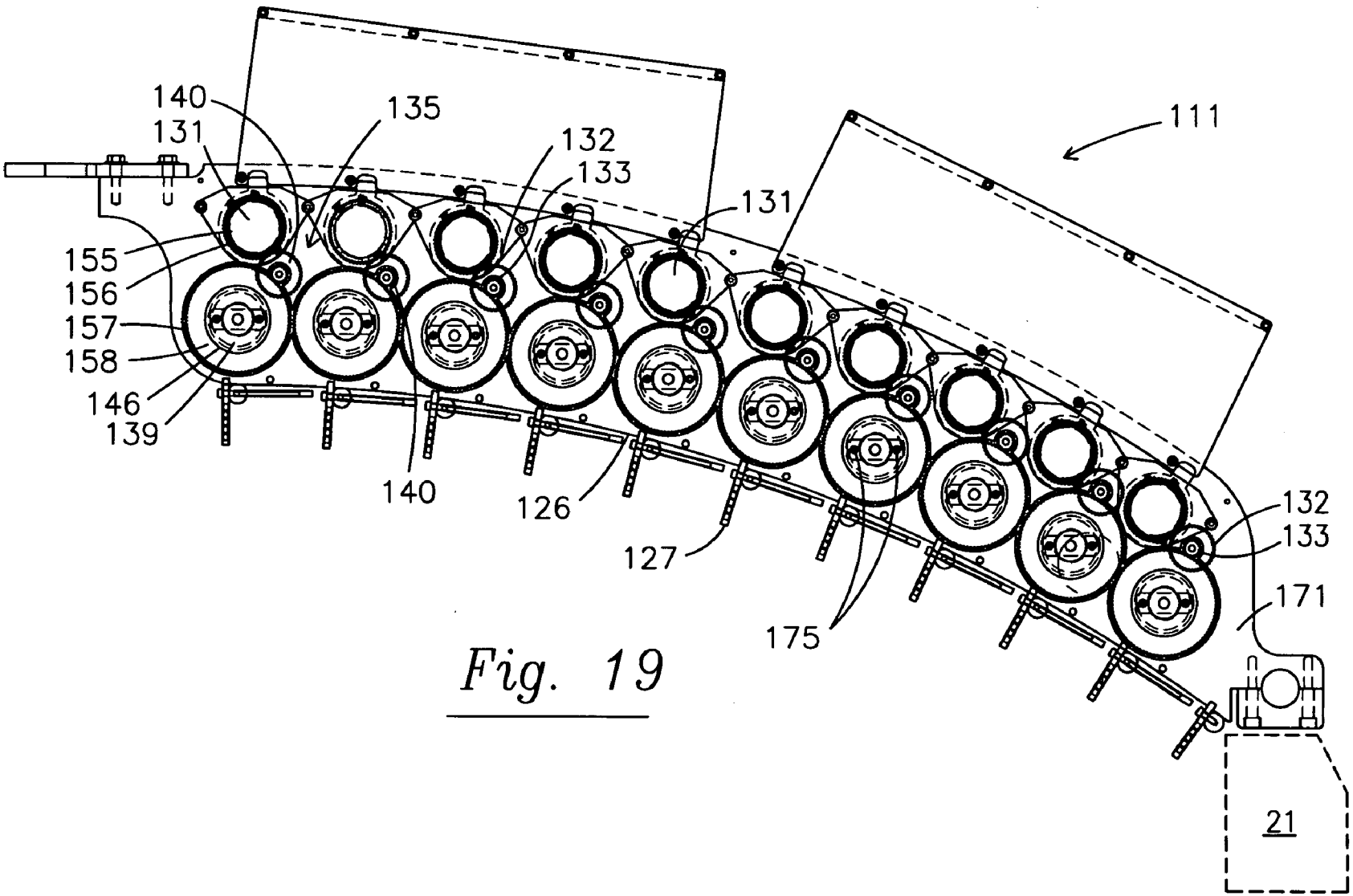
FIG. 19 is a side elevation view of a preferred embodiment of a double-end pattern control yarn feed support.

FIGS. 18 and 19 illustrate an alternative preferred embodiment of a double end servo yarn feed pattern attachment 111. In this embodiment, only about five servo motors 131 are mounted on each of the opposed surfaces 51, 52 of support bar 226. The greater longitudinal spacing between servo motors 131, now on the order of about eight to fifteen inches, permits the mounting of geared yarn feed rolls 59. On servo motors 131 is mounted a drive gear 55, having gear teeth 56 that mesh with teeth 57 of yarn feed roll 59. The overall diameter of the servo motor 31 is only about three inches, and the drive gear 55 adds little additional diameter. The overall diameter of the teethed section 58 of the geared yarn drive roll 59 may be between about six to nine inches. The diameter of the yarn feeding surface portion 28 on rolls 59 remains at about three inches. Thus, it now requires two or three revolutions of servo motors 131 to feed the same lengths of yarn that would have been fed by a single servo motor revolution in the embodiment of FIGS. 12-14. The result is that the maximum yarn feed rate has been diminished and the effective torque of yarn feed drives 135 has been increased by a factor of about two or three. Together with the yarn feeding assist provided by the capstan assembly 13, these small inexpensive servo motors may now feed four or more yarns. Unlike the extended yarn feed rolls 49 of FIG. 17, the geared rolls do not require additional lateral spacing between support bars, and about twenty-five to thirty such support bars 226 might be placed on a two meter tufting machine, with as little as 3¼ inch spacing between bar centers. Because the support bars 226 as illustrated in FIG. 18 carry twenty (or more) yarns on ten drives and are spaced just as single end drive support bars with twenty drives, no changes are necessary to spread the yarns 16 as they exit the pattern attachment 111 and proceed to the tube bank, yarn puller rollers, guides and needles.

It will be understood that the geared portion 56 of drive gear 55 and the teethed section 58 of geared yarn feed roll 59, are adjacent to the support bar 226, so as not to interfere with placement of yarns over end cap 46 and on the yarn feeding surfaces 28. This embodiment when used with a capstan assembly 13 provides the enhanced torque desired for feeding two or more yarns.

Figure 20:
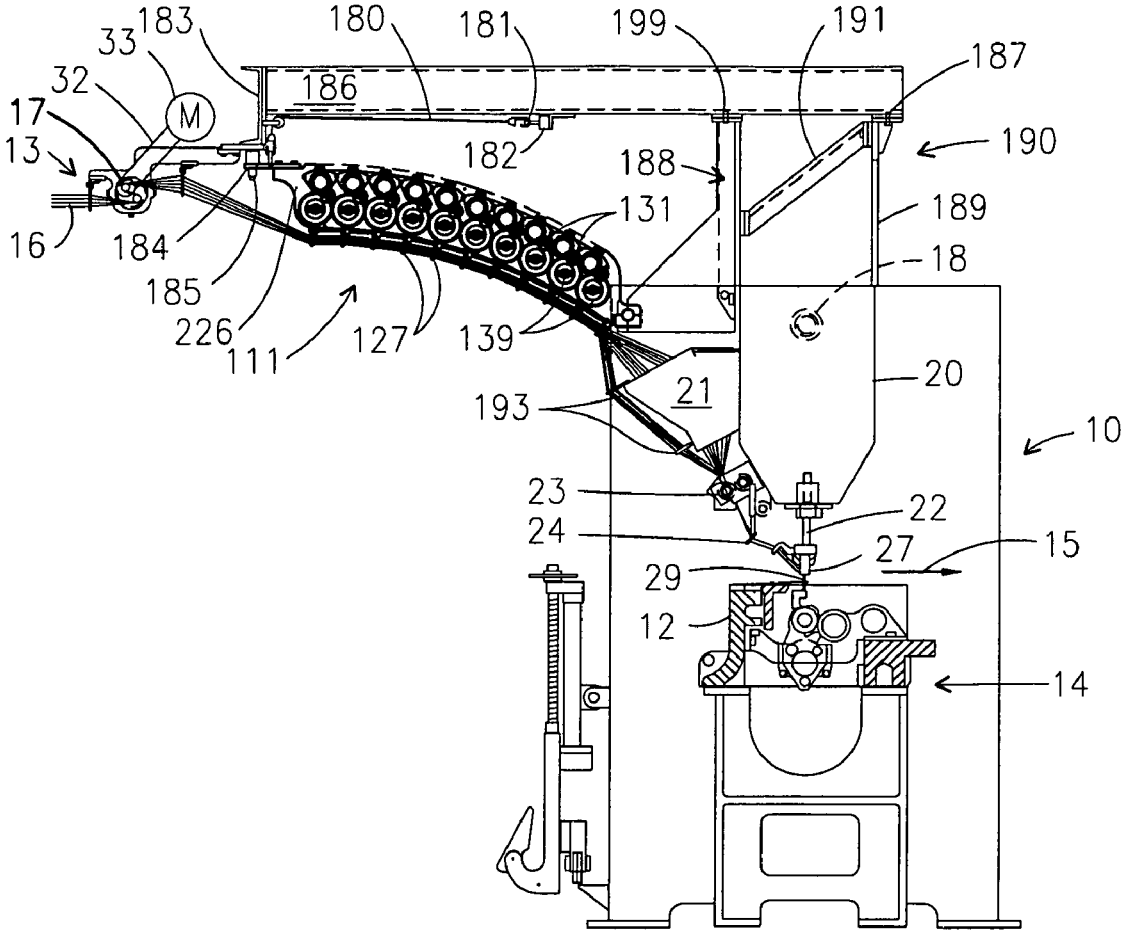
FIG. 20 is a sectional view of a tufting machine with the yarn feed attachment of FIG. 19 equipped with a capstan roller.

FIGS. 19 and 20 present an alternative double end yarn feed. The structure of FIG. 19 can also be easily modified by the simple substitution of yarn feed rolls and yarn guide plates to operate as a single end servo scroll pattern attachment. FIG. 19 shows an array of yarn drives 135 assembled on an arching support bar 126 that are mounted across the front and in some instances also the back of tufting machine 10. Support bars 126 have opposed mounting surfaces 171 and opposite surface (not shown). On the opposing side facing surfaces 171 and reverse are preferably mounted a total of twenty servo motors 131 and driven yarn feed rolls 139, ten on each side. In addition, intermediate gear wheels 140 are placed in communication between servo motors 131 and yarn feed rolls 139. The number of servo motors and yarn feed rolls on each support bar 126 may be varied as discussed in connection with previously described embodiments.

Each double end yarn drive 135 on pattern attachment 111 consists of a yarn feed roll 139 and intermediate gear 140 and a servo motor 131. Preferably, yarns are directed by yarn guide plates 127 so that yarn is wrapped around a substantial portion of the yarn feeding surface 28 of the yarn feed rolls 139. The improved pattern attachment 111 in FIG. 19 is designed to increase the torque applied by servo motors 131 to yarn feed rolls 139. This is accomplished by mounting a drive gear 155 having gear teeth 156 that mesh with large circumference portion gear teeth 132 of intermediate gear 140. When servo motor 131 rotates and correspondingly causes drive gear 155 (which is held in place by clamp 142) to similarly rotate, the result is that intermediate gear 140 rotates in the opposite direction and at a slightly higher rate of rotation due to the slightly smaller diameter and fewer gear teeth 132 in comparison to diameter of gear 155 and number of gear teeth 156. However, intermediate gear 140 has a second smaller diameter section with substantially fewer gear teeth 133 that interface with gear teeth 157 on the very large diameter at gear portion 158 of yarn feed roll 139. Because the smaller diameter section teeth 133 are only between ½ to ¼ as numerous as the larger diameter section teeth 132, the effect of intermediate gear 140 is to require about two or three times as many revolutions of servo motor 131 to accomplish a revolution of yarn feed roll 139. The result of employing the intermediate gear is that the maximum yarn feed rate is diminished and the effective torque of yarn feed drives 131 is increased by a factor of more than two, and preferably about four to five. Because the larger geared portion 138 of yarn feed rolls 139 and the smaller diameter teeth 133 of intermediate gear 140 are recessed into support 126 while yarn drive gear 155 and larger diameter section 132 at intermediate gear 140 are raised upon surfaces 171 and reverse of supports 126, it is possible to arrange a compact array of ten yarn feed drives 135 on each opposed surface 171 and reverse of support 126. A particular advantage of this construction with a servo motor driven gear 155 and intermediate gear 140 to drive yarn feed roll 139 is that the yarn feed roll 139 rotates in the same direction as the servo motor 131. In this fashion the programming utilized in connection with the pattern attachments shown in FIGS. 12-14 and 17 where the servo motors directly drive yarn feed rolls, does not require adjustment. In the alternative construction of FIG. 18 the servo motors rotate in the opposite direction of the yarn feed rolls, and it is necessary to utilize different programming to compensate for this characteristic.

A further advantage of the embodiment of FIG. 19 is that in order to convert an attachment from a double end yarn feed drive to a single end yarn feed drive, the only changes required are the replacement of yarn feed rolls 139 with relatively wide yarn feeding surfaces 28 and the replacement of relatively guides 137. The resulting high torque single end yarn drive can be constructed with very few modifications to components utilized in the improved double end yarn feed drive. While the use of an intermediate gear 140 does introduce the possibility of some lost motion in driving yarn feed rolls 139, bolts 175 permit yarn feed roll 139 to be adjusted in the direction of the axis of intermediate yarn feed roll 140 and thereby minimize any play or slack in the gears.

Referring now to FIG. 20, a tufting machine 10 with an alternative mounting of double end scroll pattern attachment 111 and tube bank 21 is reflected. A transverse beam 105 at the front of double end pattern attachment 111 is connected to a plurality of longitudinal beams 186 to provide a top support structure for the array of support arms 226 of the double end yarn feed pattern attachment 111. A main drive motor drives a rotary main drive shaft 18 mounted in the head 20 of the tufting machine. Drive shaft 18 in turn causes push rods 22 to move reciprocally toward and away from the base fabric. As reflected in FIG. 20, this causes needle bar 27 to move in a similar fashion. Needle bar 27 supports a plurality of preferably uniformly spaced needles 29 aligned transversely to the fabric feed direction 15.

In operation, yarns 16 are fed through capstan rollers 17 of capstan assembly 13 into the double end pattern control yarn feed device 111. After exiting the yarn feed device 111, yarns 16 are fed either into tube bank 21, or alternatively through yarn guides 193, and then in a conventional manner through yarn puller rollers 23 and yarn guides 24 to needles 29. In order to place the double end pattern control yarn feed attachment 111 at an appropriate position for use with tube bank 21, an extender 190 having front wall 188, back wall 189, internal cross beam support 191 and side walls (not shown) is mounted to the head 20 of the tufting machine 10. The upper support structure of beams 186, 105 is then secured to this extender 190 by mounting plates 199, 187 at the tops of front and back walls 188, 189.

Additional features of the double end pattern control yarn feed attachment 111 include a separator or bumper 184 and bolt 185 which permits support arms 226 to be removably secured at their front ends to the upper support structure. In order to prevent support arms 26 from pivoting out of control, elastic cord 180 is secured at one end to mounting bracket 182 and eyelet 181 beneath longitudinal supports 186, then around pulley 183 and then attached to a forward end of each arch support 26. The restraint of cord 80 prevents arch supports 26 from falling precipitously when bolts 85 are released in order to permit support arms 226 to pivot down for maintenance of servo motors 131, yarn feed rolls 139, or the threading of yarns about yarn feed rolls 139 and through yarn guides 127.

All publications, patents, and patent documents mentioned above are incorporated by reference herein as though individually incorporated by reference. While preferred embodiments of the invention have been described above, it is to be understood that any and all equivalent realizations of the present invention are included within the scope and spirit thereof. Thus, the embodiments depicted are presented by way of example only and are not intended as limitations upon the present invention. While particular embodiments of the invention have been described and shown, it will be understood by those skilled in the art that the present invention is not limited thereto since many modifications can be made. Therefore, it is contemplated that any and all such embodiments are included in the present invention as may fall within the scope or equivalent scope of the appended claims.

We claim:

1. In a tufting machine of the type having a plurality of yarns supplied to needles reciprocated through a backing fabric and a pattern control yarn feed attachment with a plurality of independently driven yarn feed devices, an improvement comprising a first driven capstan roller located intermediate the yarn supply and the independently driven yarn feed devices wherein the plurality of yarns is wrapped completely about a circumference of the capstan roller and proceeds through a pattern control yarn feed attachment to the needles.

2. The improvement of claim 1 wherein the independently driven yarn feed devices are yarn feed rolls driven by servo motors.

3. The improvement of claim 2 wherein the capstan roller is rotated by communication with a servo motor that also rotates a yarn feed roll.

4. The improvement of claim 1 wherein the capstan roller is rotated by communication with a main drive motor of the tufting machine.

5. The improvement of claim 1 wherein the capstan roller is rotated by an independent capstan motor.

6. The improvement of claim 5 wherein the capstan motor has a motor controller in communication with a tufting machine master controller.

7. The improvement of claim 1 wherein the capstan roller is driven to supply yarns at a rate at least equal to the fastest rate of yarn supplied by the independently driven yarn feed devices.

8. The improvement of claim 1 further comprising a second capstan roller located proximate and parallel to the first capstan roller.

9. The improvement of claim 8 wherein the plurality of yarns is wrapped around at least 180° of the first capstan roller which is rotationally driven in a first direction and further wrapped around at least 180° of the second capstan roller which is rotated in the opposite direction.

10. A capstan roller assembly adapted for use intermediate a yarn supply and a pattern control yarn feed attachment of a tufting machine comprising:

first and second capstan rollers being positioned proximate to and parallel with one another for rotational movement;

the first and second capstan rollers having associated, intermeshing spur gears for rotational communication with one another;

a drive belt in communication between a motor and the first capstan roller;

wherein yarns proceed from the yarn supply, between the first and second capstan rollers and thence to the pattern control yarn feed attachment.

11. The capstan roller assembly of claim 10 wherein yard is fed from the yarn supply toward the tufting machine under and about at least 180° of the circumference of the second capstan roller and thence rearward under and about at least 180° of the circumference of the first capstan roller and thence forward to the pattern control yarn feed attachment.

12. The capstan roller assembly of claim 10 wherein a bushing is mounted on each end of the first and second capstan rollers, said bushings being received in openings in capstan roller brackets.

13. The capstan roller assembly of claim 10 wherein the motor is the main drive motor of the tufting machine.

14. The capstan roller assembly of claim 10 wherein the motor also is in communication with a yarn feed roll of the pattern control yarn feed attachment.

15. The capstan roller assembly of claim 10 wherein the motor has a motor controller in communication with a tufting machine master controller.

16. The capstan roller assembly of claim 10 wherein the yarn feed attachment is selected from the group of servo scroll yarn feed, single end yarn feed, and double end yarn feed attachments.

17. A capstan roller assembly adapted for use intermediate a yarn supply and a pattern control yarn feed attachment having a plurality of independently driven yarn feed devices supplying yarns to needles of a tufting machine comprising:

a first capstan roller being positioned wherein a bushing is mounted on each end of the roller and each bushing is received in an opening in a capstan roller bracket for rotational movement of the capstan roller; and a drive belt in communication between a motor and the first capstan roller;

wherein yarns proceed from the yarn supply, about the first capstan roller and thence to the pattern control yarn feed attachment.

18. The capstan roller assembly of claim 17 wherein the plurality of yarns is wrapped completely about a circumference of the capstan roller.

19. The capstan roller assembly of claim 17 wherein the capstan roller is driven to supply yarns at a rate at least equal to the fastest rate of yarn supplied by the independently driven yarn feed devices.

20. In a tufting machine of the type having a plurality of yarns supplied to needles reciprocated through a backing fabric and a pattern control yarn feed attachment with a plurality of independently driven yarn feed devices, an improvement comprising of first driven capstan roller located intermediate yarn supply and the independently driven yarn feed devices and a second capstan roller located proximate and parallel to the first capstan roller, wherein the plurality of yarns proceeds from the yarn supply and is wrapped around at least 180° of the first capstan roller which is rotationally driven in a first direction and further wrapped around at least 180° of the second capstan roller which is rotated in the opposite direction, and thence to the independently driven yarn feed devices of the pattern control yarn feed attachment.

21. The improvement of claim 20 wherein the independently driven yarn feed devices are yarn feed rolls driven by servo motors.

22. The improvement of claim 21 wherein the first capstan roller is rotated by communication with a servo motor that also rotates the yarn feed roll.

23. The improvement of claim 20 wherein the plurality of yarns is wrapped completely about a circumference of the first capstan roller.

24. The improvement of claim 20 wherein the first capstan roller is rotated by communication with a main drive motor of the tufting machine.

25. The improvement of claim 20 wherein the first capstan roller is rotated by an independent capstan motor.

26. The improvement of claim 25 wherein the capstan motor has a motor controller in communication with a tufting machine master controller.

27. The improvement of claim 20 wherein the first capstan roller is driven to supply yarns at a rate at least equal to the fastest rate of yarn supply by the independent driven yarn feed devices.

* * * * *